United States Patent [19]

Hagedorn

[11] 4,308,712

[45] Jan. 5, 1982

[54] CARTON BLANK FOLDING APPARATUS

[76] Inventor: Hans Hagedorn, 4470 - 272nd St., Aldergrove, British Columbia, Canada, V0X 1A0

[21] Appl. No.: 118,271

[22] Filed: Feb. 4, 1980

[51] Int. Cl.[3] ..... B65B 41/06; B65B 47/10

[52] U.S. Cl. ..... 53/566; 53/574; 493/124; 493/317

[58] Field of Search ..... 53/564, 566, 374, 574, 53/458, 457; 493/124, 123, 126, 127, 315–317, 313

[56] References Cited

U.S. PATENT DOCUMENTS

| | | | |
|---|---|---|---|
| 3,613,525 | 10/1971 | Lense et al. | 493/315 |
| 3,747,294 | 7/1973 | Calvert et al. | 53/564 X |
| 3,782,071 | 1/1974 | Hagedorn | 53/574 |

*Primary Examiner*—James F. Coan

*Attorney, Agent, or Firm*—Townsend and Townsend

[57] ABSTRACT

Apparatus having a vacuum arrangement for reaching up to grip a flat carton blank and to draw the blank downwardly onto a support. As the blank is moved downwardly, it is drawn into an expanding U formation ready to receive a load of articles which are moved along a path and onto the bottom of the deposited blank, after which the blank is folded into a carton and secured relative the article load. While the loading, folding and securing operations are taking place, the vacuum arrangement moves back to grip the next carton blank that is to be loaded. The apparatus for moving each load inwardly on to the deposited blank allows for the formation of another load while the moving is taking place, said apparatus moving outwardly over the newly formed load.

30 Claims, 23 Drawing Figures

Figure 1:
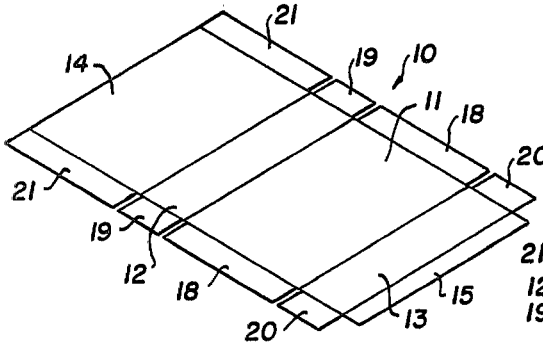

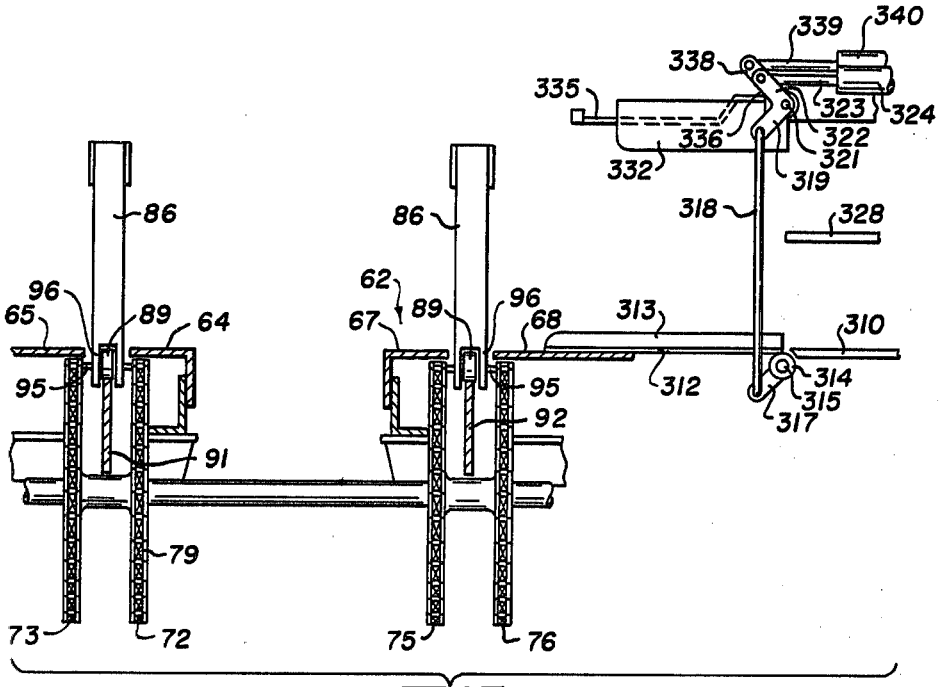
Fig. 12.
Fig. 15.
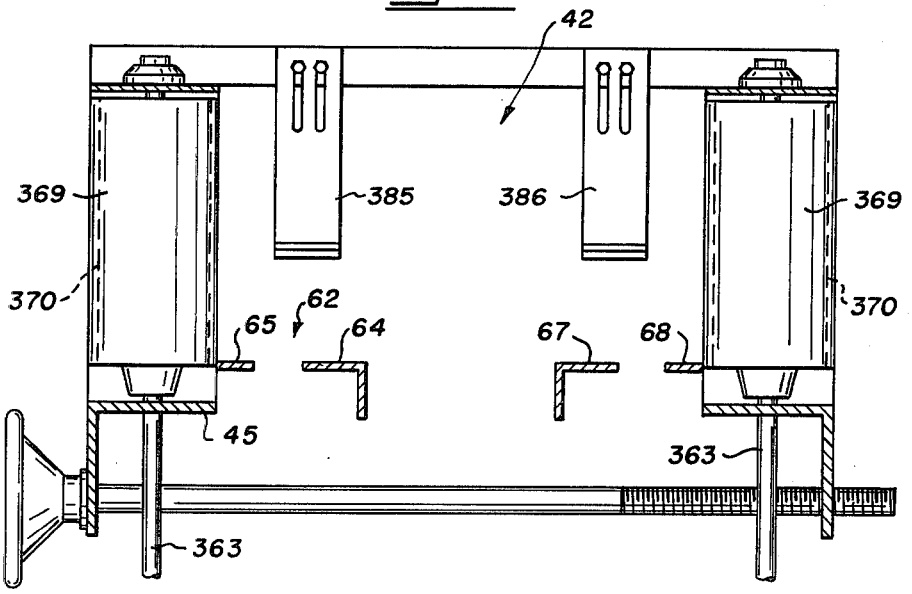

CARTON BLANK FOLDING APPARATUS

This invention relates to apparatus for partially forming a carton blank into a closable carton or a tray carton, moving a load of articles, such as cans, bottles, packages, and the like onto the bottom of the partially formed carton, and then wrapping the blank around the load and securing the wrapped blank therearound.

This apparatus is an improvement of the carton forming and loading apparatus illustrated and described in U.S. Pat. No. 3,782,071 dated Jan. 1, 1974. The carton forming and loading apparatus of this patent functions very well, but it is relatively slow. Although the patented apparatus results in a superior finished loaded carton in much less time than the apparatus of the prior art, still it is desirable to cut down the length of time of each forming and loading operation.

The apparatus of the above-mentioned patent is particularly designed for handling flat carton blanks having top and bottom panels, side walls, side end flaps and top and bottom end flaps, as is the present apparatus. In the patented apparatus, each carton blank is drawn by a suction arrangement downwardly into an expanding U formation, and after the side end flaps at one end of the blank are folded inwardly, a load of articles is moved onto the bottom panel of the blank. The remaining side end flaps are folded inwardly and the top panel is swung inwardly onto the top of the load and secured in place. As the partially-formed carton and its load is moved away from the loading position, the top and bottom end flaps are folded inwardly and secured together to complete the carton around the load. As soon as the load moves out of the loading position, the vacuum arrangement moves up to grip the next carton blank in order to repeat the process. The vacuum arrangement has to wait until the loaded carton is moved out of the loading position, before the vacuum arrangement can reach up for the next blank.

The apparatus of the present invention cuts the time of a complete operation down a considerable amount without necessarily increasing the speed of movement of the various components. This is accomplished by making the vacuum arrangement such that it can move upwardly to grip the next carton blank while the previous carton blank is being loaded, partially formed in the loading position and then moved out of said position. This apparatus also includes means for retaining each carton blank in the open U formation exactly in its correct position while a load is being shifted onto the bottom panel of the blank and while the vacuum arrangement is returning for the next carton blank.

The present apparatus also includes a pusher arrangement for moving a load of articles onto the bottom panel of a partially-formed carton blank in the loading position. As this pusher arrangment is moving a load onto the carton blank, another load of articles is formed behind the pusher arrangement. The pusher arrangement is such that it can be retracted over the incoming load to a position ready to shift the latter load onto a carton blank. This also reduces the time of the operation relative to that of the apparatus of U.S. Pat. No. 3,782,071 without the necessity of increasing the speed of movement of any of the involved components.

In an alternative form of the present apparatus, tray cartons can be formed, that is, cartons without top panels and top end flaps. There is a demand for loading articles into carton-type trays which are open at the top so that the articles can be seen. A piece of transparent material, such as pliofilm, can be stretched over the open top of the loaded carton tray and then secured thereto. The loaded articles can be seen through the transparent material, and use of this material results in a considerable saving in the cost of the carton material. The alternative apparatus can form the loaded tray cartons so that they are ready to receive the transparent covering material.

In addition, this apparatus for forming and loading cartons can, after a simple adjustment, be used to form tray cartons, and vice versa.

Apparatus in accordance with this invention includes a hopper for supporting a column of carton blanks without the weight of the column resting on the lowermost blank. Suction or vacuum means draws the lowermost blank down into loading position, and during this movement side portions of the blank are folded upwardly into expanding U formation. After a pair of side end flaps at one end of the blank have been folded inwardly, a single tier or double tier of articles is or are moved onto the bottom panel of the blank and against the infolded side end flaps. The articles are fully visible during this operation so that it is immediately known if any article is out of position. End flaps at the opposite end of the blank are folded inwardly and the top panel is folded downwardly over the load. The top panel is secured in this position in any suitable manner, such as by glueing or staples. The loaded carton is now moved out of the loading position and along a path where the upper and lower end flaps at both ends of the carton are folded inwardly and secured in position. Although any suitable means may be used for holding the elements of the carton together, such as staples, it is preferably to use glue for this purpose in accordance with the general practice. Glue is applied where necessary before the top and bottom end flaps are folded into final position and pressure applied thereto.

Prior to the loading operation, the load containers are formed into a single tier or double tiers. For a single tier, the containers are formed into a group of a desired number and in a predetermined number of rows. Suitable means moves this group into position over the bottom panel of the blank which has been drawn down into the loading position. If a double tier is required, two groups of the desired number of containers are separately formed, and then one tier is placed on a plate over the other tier, following which the tiers are moved into the forming apparatus. The containers of the upper tier are usually staggered relative to those of the lower tier, and when the lower tier reaches its final position, the upper tier continues to move until each upper container is over and rests upon a lower container.

As stated above, the forming and loading operation of the present apparatus takes considerably less time then the same type of apparatus of the prior art. The reason for this is that while the partial formation of the carton around the loading is taking place, the vacuum arrangement that draws the carton blanks down into the loading position can move back to grip the next carton blank to be drawn down. The vacuum arrangement comprises a vacuum or suction arm swingably mounted on the end of a carrier located beside the passageway along which the blanks are moved from the hopper into the loading position. Control means is connected to the suction arm to maintain said arm in a substantially horizontal attitude when it is gripping the carton blank and moving it down into the loading position. As the carrier is moving back for the next carton blank, the control means operates to maintain the suction arm in a substantially vertical attitude clear of the blank in the loading position. Vacuum cup means carried by the suction arm engages the next blank when the carrier is moved upwardly to the latter and deposits this blank onto suitable supporting means in the loading position when the carrier moves downwardly.

In the present apparatus, each loaded and partially-formed carton is shifted out of the loading position along a path where the final folding operations take place. This can be done at this time because the top panel is secured in position with the side end flaps folded inwardly. However, when open-topped tray cartons are being partially formed and loaded, there is nothing in the tray formation to hold the various elements together while the loaded tray is being moved out of the loading position. When the apparatus is set up for forming and loading trays, the apparatus has holders for retaining the side walls thereof firmly in position when the tray is being moved out of the loading position.

Apparatus in accordance with this invention for folding carton blanks having a bottom panel, side walls and end flaps, comprises supporting means in a forming section, a hopper at the forming section above the supporting means for holding a stack of substantially flat carton blanks, vacuum means for engaging while in an operative attitude the lowermost blank of the stack in the hopper and moving said engaged blank downwardly through a passageway between the hopper and the supporting means and on to the supporting means, forming means besides the passageway for engaging side portions of the blank being moved downwardly through the passageway to incline said side portions into a partially formed carton in the configuration of an outwardly expanding U while leaving an end of the carton completely open, a carrier for the vacuum means for moving said vacuum means between the hopper and the supporting means, control means for the vacuum means for moving said vacuum means after a blank has been deposited on the supporting means to an inoperative position to a first side of the passageway clear of the deposited blank and moving said vacuum means back to the operative position after the vacuum means has been moved above said deposited blank, and means defining a path for moving a load of articles horizontally through a second side of the passageway and through said open carton end onto the bottom panel of the deposited blank within the U formation thereof.

Figure 5:
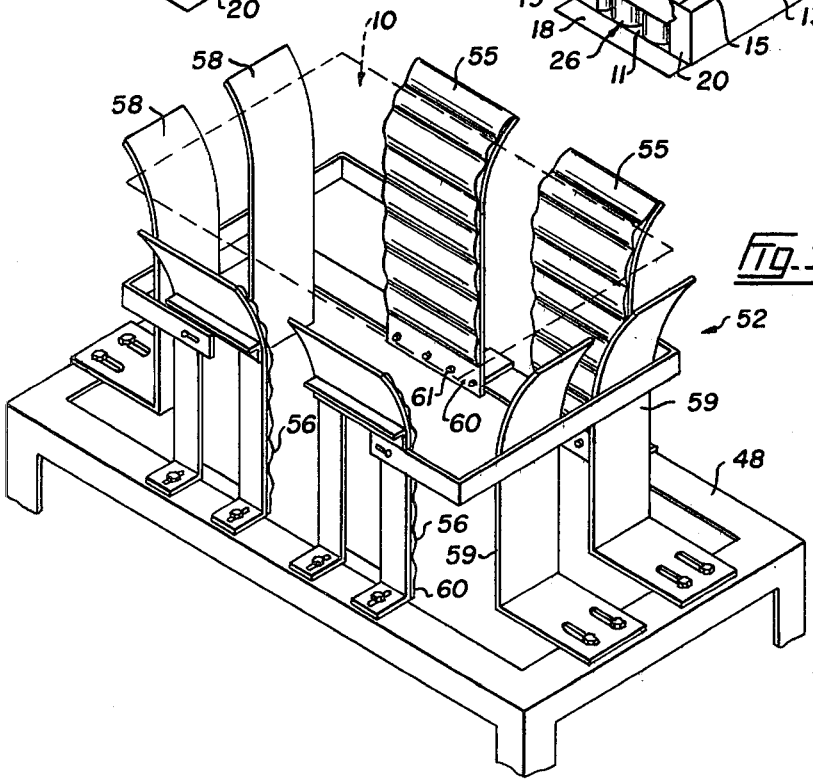
Figure 6:
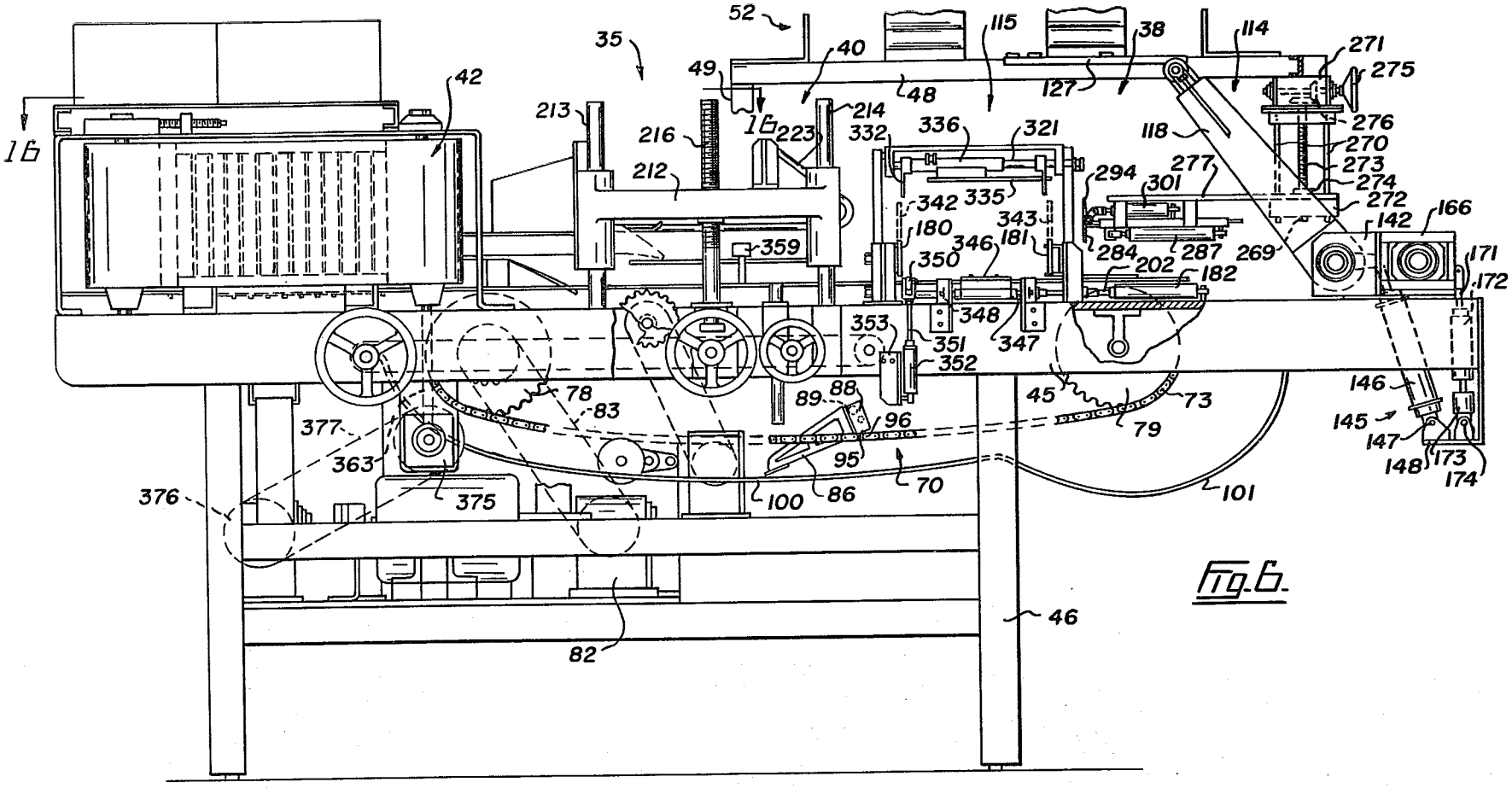
Figure 7:
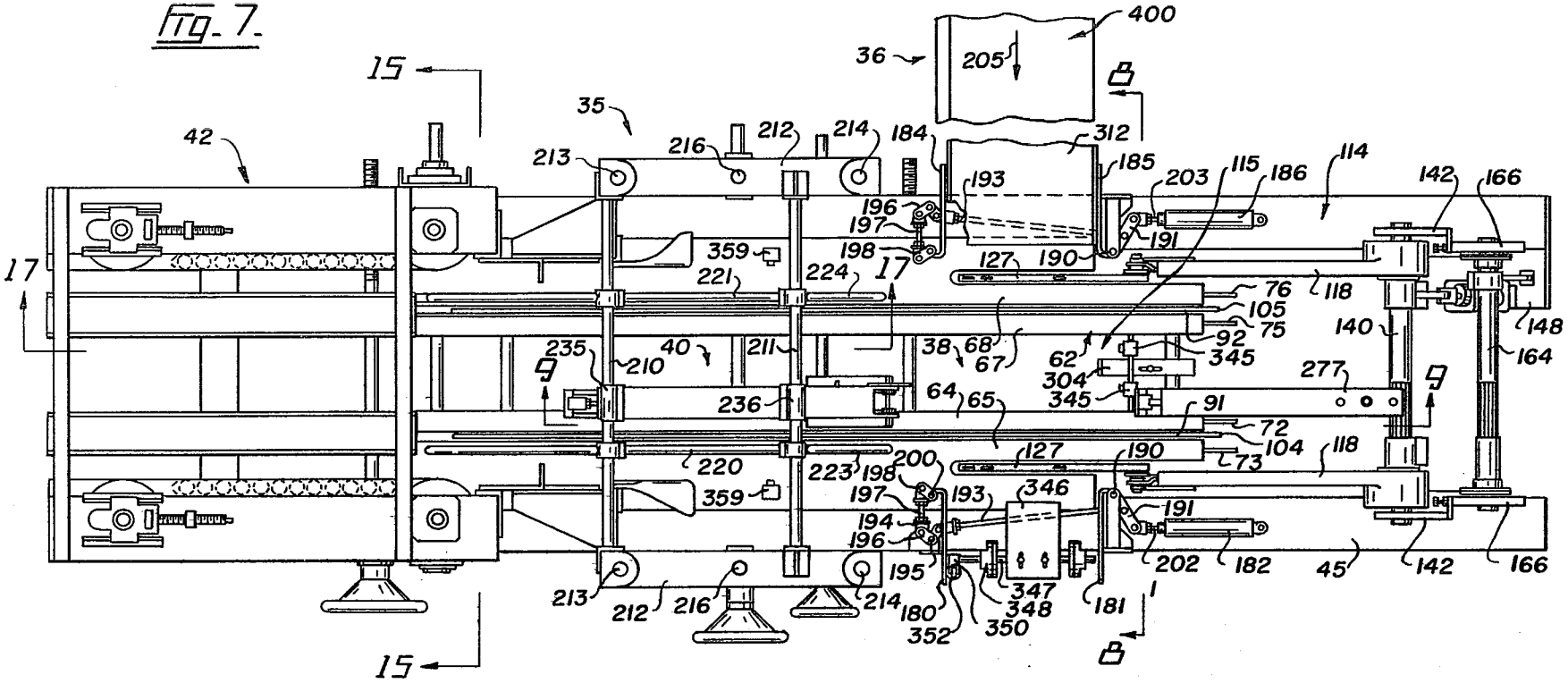
Figure 8:
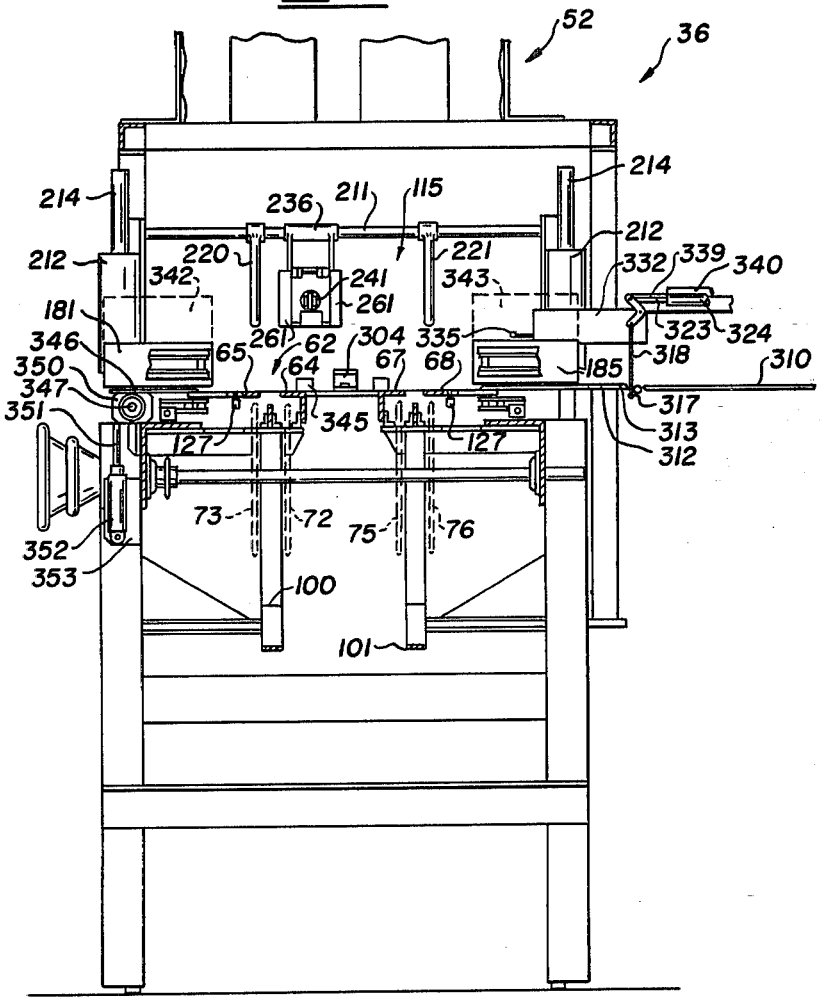
Figures 9, 10, 11:
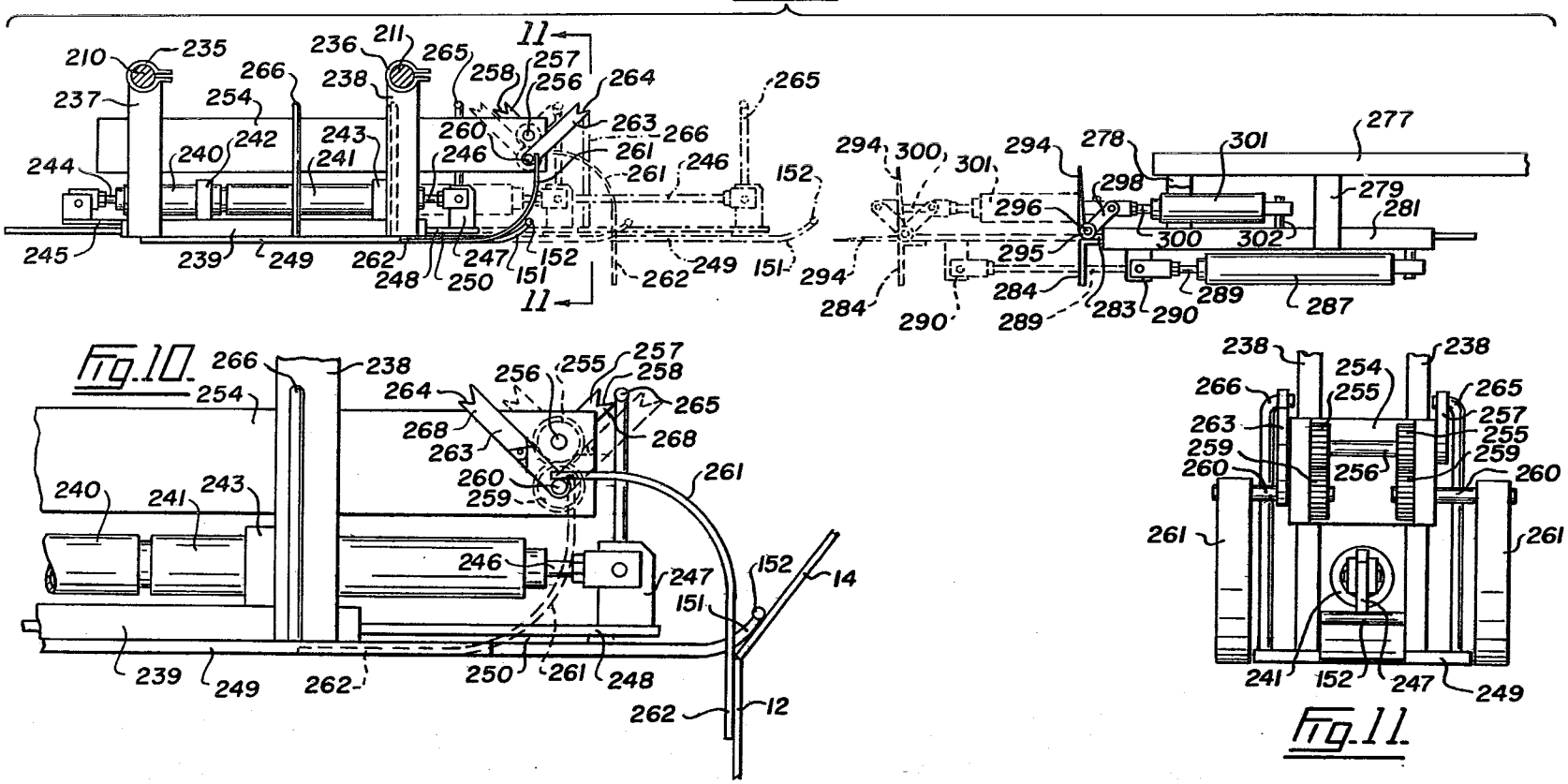
Figure 13:
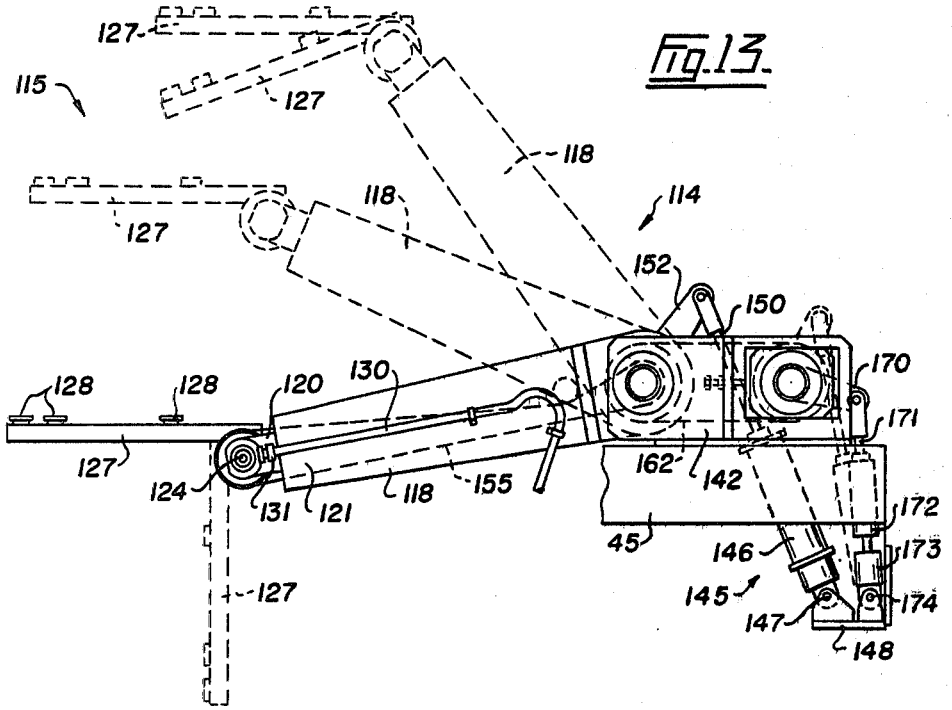
Figure 14:
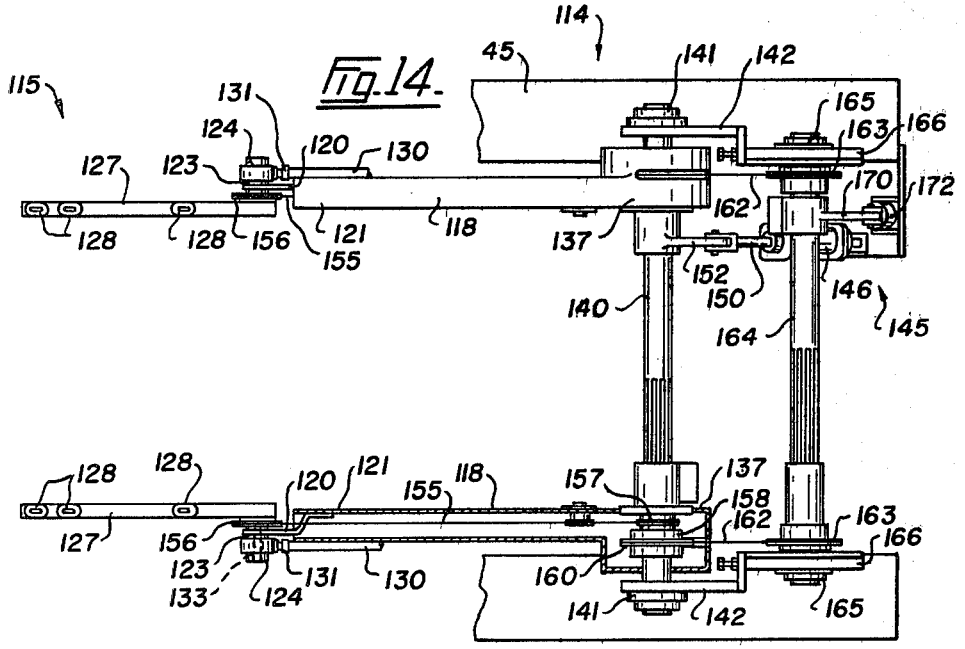
Figure 16:
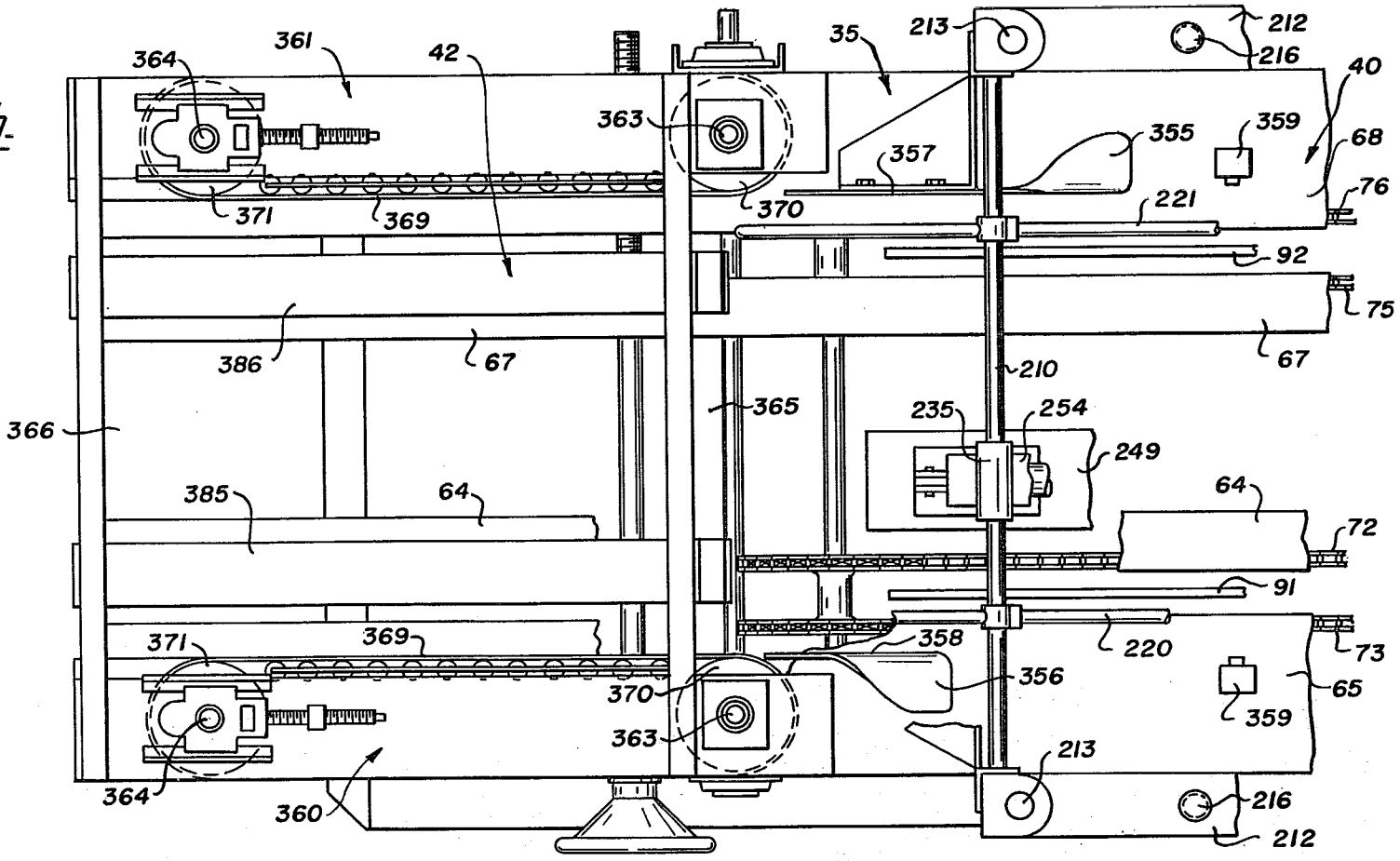
Figure 17:
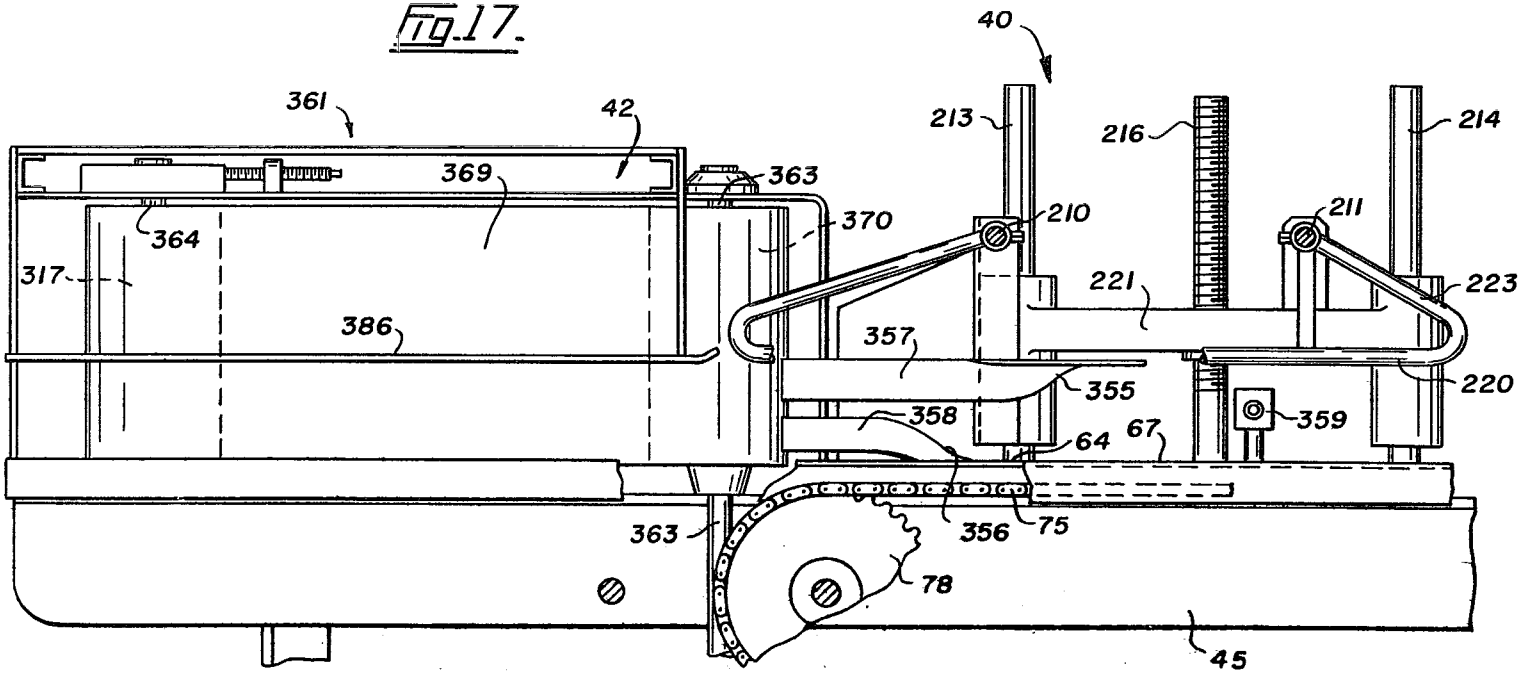
Figures 18, 19, 20:
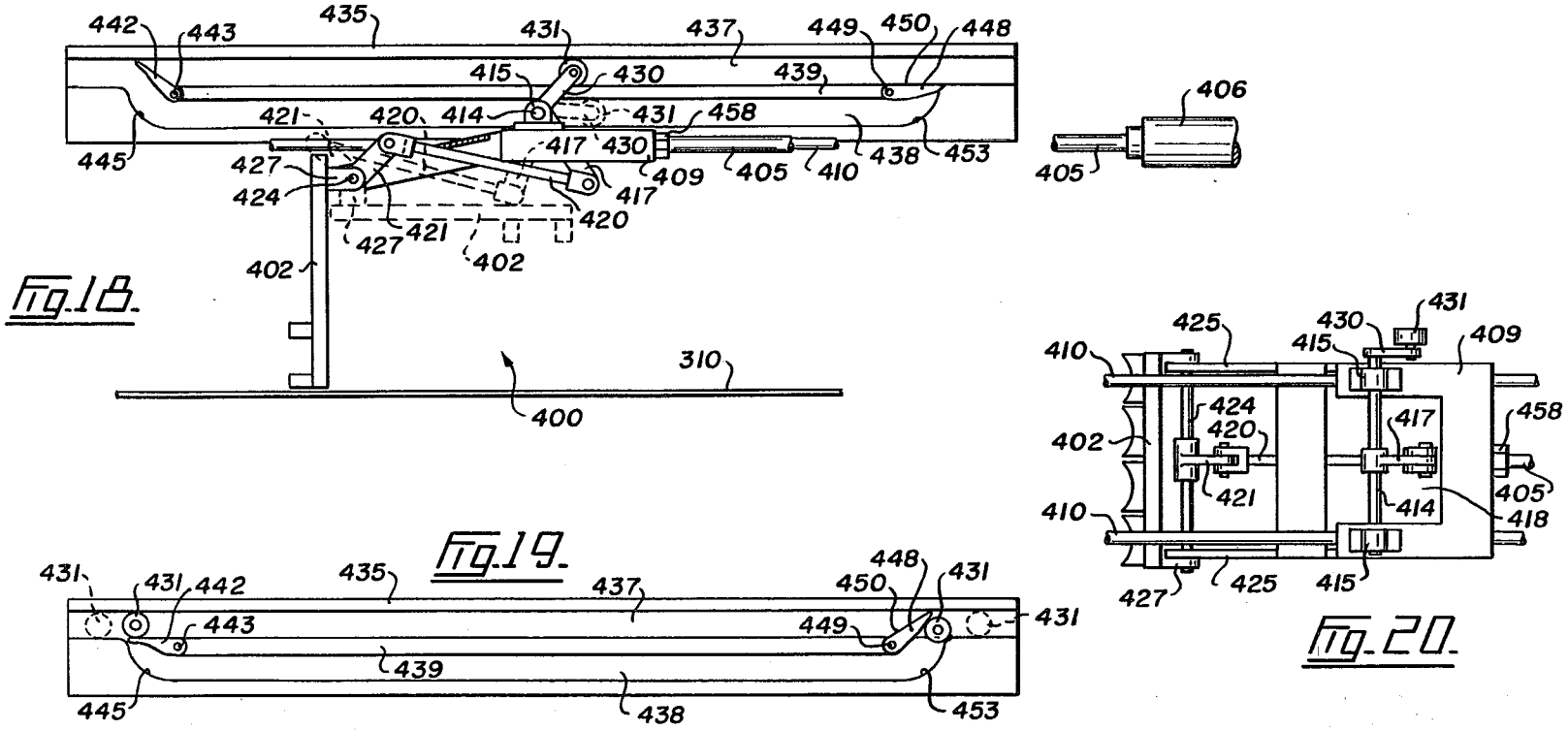
Figure 21:
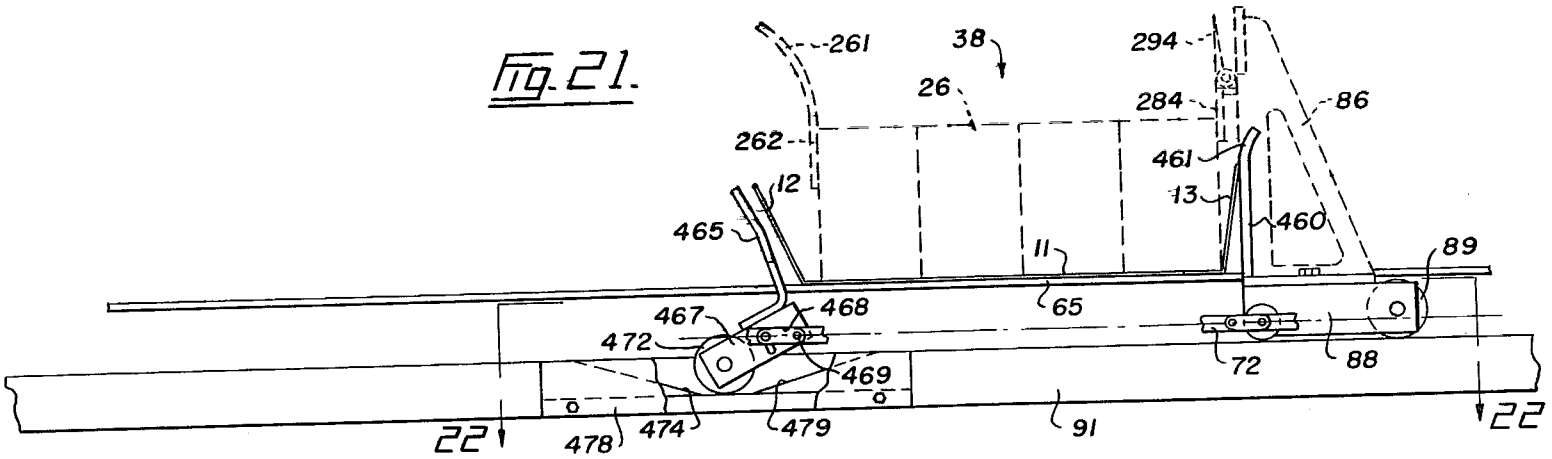
Figure 22:
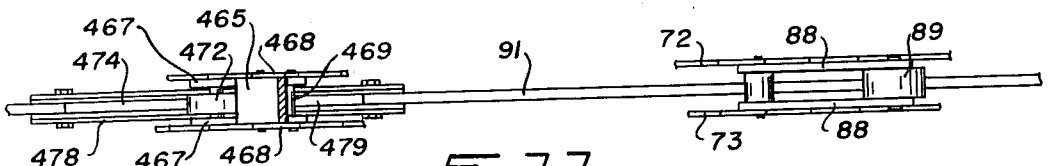
Figure 23:
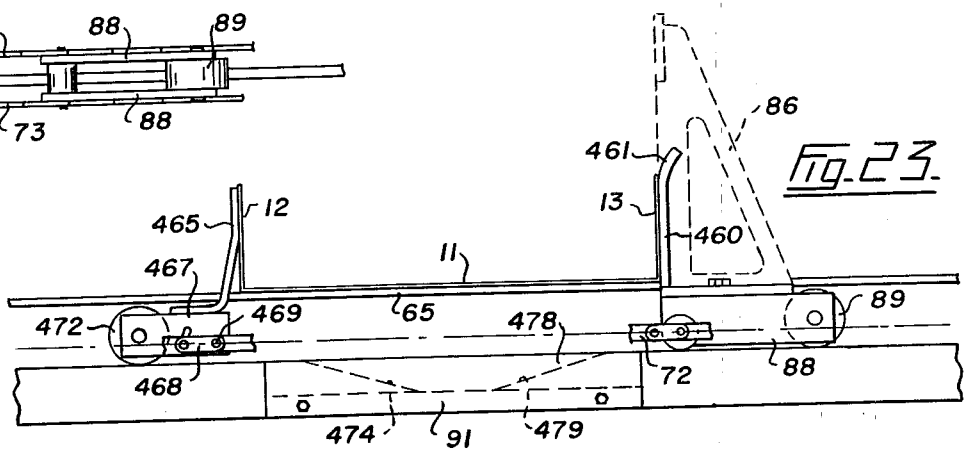

Examples of apparatus in accordance with this invention are illustrated in the accompanying drawings, in which:

FIGS. 1 to 4 diagrammatically illustrate a blank being folded into a carton,

FIG. 5 is an enlarged isometric view of the hopper of the apparatus for holding the carton blanks, FIG. 6 is a side elevation of the carton blank folding and loading apparatus, FIG. 7 is a plan view of this apparatus with some of the infeed mechanism removed for clarity, FIG. 8 is a vertical section taken on the line 8—8 of FIG. 7, FIG. 9 is an enlarged fragmentary longitudinal section taken on the line 9—9 of FIG. 7 showing the mechanism for successively moving the side walls of the blank into position against an article load and folding the glue flap and the top panel over the load;

FIG. 10 is an enlarged fragmentary elevation showing part of the mechanism of FIG. 9 part way through its folding operation, FIG. 11 is a vertical section taken on the line 11—11 of FIG. 9, FIG. 12 is an enlarged end elevation of the conveyor of this apparatus, omitting the background details, and including an infeed ramp and a stabilizer plate in side elevation, FIG. 13 is an enlarged side elevation of the vacuum means and carrier therefor in the "down" position, FIG. 14 is a plan view of the apparatus of FIG. 13, FIG. 15 is a section taken on the line 15—15 of FIG. 7, FIG. 16 is an enlarged horizontal section taken on the line 16—16 of FIG. 6, FIG. 17 is a section taken on the line 17—17 of FIG. 16, FIG. 18 is an enlarged side elevation of a pusher for moving loads into the loading position, FIG. 19 is a fragmentary elevation of the apparatus of FIG. 18, but with some of the parts removed, FIG. 20 is a plan view of part of the pusher apparatus of FIG. 18, FIG. 21 is a fragmentary elevation of an alternative conveyor arrangement to enable this apparatus to form and load tray cartons, showing the carton blank to open U formation ready to receive a load, FIG. 22 is a horizontal section taken on the line 22—22 of FIG. 21, and FIG. 23 is a view similar to FIG. 21 but with a formed tray carton being moved out of the loading position, the load of the carton being omitted for the sake of clarity.

GENERAL

Referring to FIGS. 1 to 4 of the drawings, 10 is a carton blank creased and cut to form a bottom panel 11, side walls 12 and 13, a top panel 14 and a narrow securing or glue flap 15. The blank has the same flap arrangement at each end thereof, and this includes bottom end flaps 18, side end flaps 19 and 20, and top end flaps 21. The length of securing flap 15 is about the same as that of top panel 14.

Figure 4:
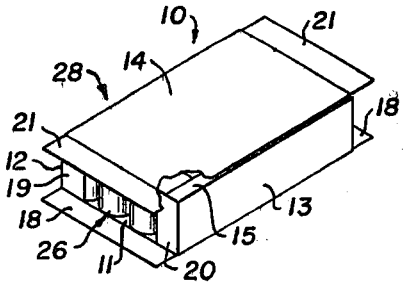

The folding and loading of the carton or case takes place in successive steps in the folding and loading apparatus of this invention. The flat blank 10 is drawn downwardly by suction means from the bottom of a hopper into the upwardly expanding U formation illustrated in FIG. 2. Side end flaps 19 and 20 at one end of the blank are folded inwardly, and then the load of articles, such as cans 26, is moved over bottom panel 11, after which end flaps 19 and 20 at the opposite end of the blank are folded inwardly. Side wall panels 12 and 13 are pressed into vertical positions, and glue, if glue is the securing means, is applied to the outer surface of glue flap 15. The glue flap is folded inwardly, and top panel 14 is folded over the load and down onto the glue flap to form carton or case 28, as illustrated in FIG. 4. The carton is moved out of the loading position and during this movement glue is applied to portions of side end flaps 19 and 20 of both ends of the carton, and lower and upper end flaps 18 and 21 are folded inwardly. Pressure is maintained against upper panel 14 during this time, and pressure is applied to the end flaps for a period sufficient to enable the glue or adhesive to take a firm hold. Although this apparatus is described in connection with the use of glue for securing the flaps together, it is to be understood that other fastening means may be used, such as, for example, stapling means. In this case, stapling guns would be suitably located to secure top panel 14 to flap 15, and to secure the two sets of end flaps 18 and 21 in closed position.

FIGS. 5 to 21 illustrate carton blank folding and loading apparatus 35 for forming a flat blank into a partial carton or tray carton, loading the carton, and finishing the carton around the load. Apparatus 35 includes a feed section 36 in which articles to be wrapped are gathered, a forming section 38 in which the carton is formed with articles therein, a folding section 40 in which the upper and lower end flaps are folded and glued in position, and a sealing section 42 in which the flaps are pressed until the glue can firmly hold them in position.

FORMING SECTION

Apparatus 35 includes a base frame 45 mounted on supports or legs 46, and a supporting frame 48 carried by vertical supports 49 extending upwardly from the base frame. Supporting frame 48 is located above forming section 38 and folding section 40.

A hopper 52 is mounted on supporting frame 48 above forming section 38. This hopper holds a stack of blanks 10 above the forming section, see FIG. 5. Hopper 52 is made up of a pair of opposed corrugated walls, and a pair of opposed smooth walls. The corrugations of the opposed walls correspond to each other, that is, if a corrugation of one wall projects inwardly of the hopper, the corresponding or opposite corrugation of the opposite wall projects outwardly of the hopper. The term "corrugation" as used herein is intended to cover the undulating structure shown, an angular zigzag arrangment, or similar structure. The blanks in the hopper rest upon these corrugations so that each set of corrugations supports only a few blanks thereabove. The blanks at the bottom of the hopper rest on suitable supports spaced a little below the lowest corrugations. As there is only the weight of a few blanks on these supports, it is possible to draw the lowermost blank downwardly out of the hopper without having to apply undue force and without danger of tearing the blank. The hopper does not have any bottom, and the lowermost blank is supported by the lowermost opposed corrugations of the hopper walls.

FIG. 5 illustrates hopper 52. Instead of having opposed solid walls, the walls of this hopper are made up of pairs of opposed plates in order to save material and reduce weight and friction. In this example, one wall of the hopper is made up of pair of corrugated plates 55 and the opposite wall by a pair of corrugated plates 56, the corrugations of which correspond as described above. The remaining two walls are made up of pairs of plain plates 58 and 59, all of these plates being suitably mounted on supporting frame 48 and projecting upwardly therefrom. Each of the plates 55 and 56 is formed with a straight vertical section 60 below its lowermost corrugation, and a suitable support projects inwardly of the hopper from this section. In this example, the support is made up of a plurality of small cleats 61. The ends of a few of the lowermost blanks rest upon support cleates 61 while the rest of the blanks are supported in small groups by the corrugations of plates 55 and 56. Plates 58 and 59 keep the blanks in proper alignment over forming section 38.

Track or support means 62 extend through the apparatus sections 38, 40, 42, see FIGS. 7, 8, 12 and 15, and consists of a pair of spaced plates 64 and 65 laterally spaced from another pair of spaced plates 67 and 68. These plates act as tracks upon which each blank is formed into a carton and then is transported through the apparatus. Either or both of the pairs of plates 64, 65 and 67, 68 is or are adjustable laterally of the apparatus so as to be able to accommodate cartons of different sizes. A conveyor 70 is provided for moving the cartons through the apparatus. In this example, conveyor 70 consists of a pair of chains 72 and 73 located beneath plates 64 and 65, and another pair of chains 75 and 76 located beneath plates 67 and 68, see FIG. 12. These chains extend around sprockets 78 and 79 located at the outer ends of adjacent sections 40 and 38 of the apparatus. The sprockets for chains 72 and 73 are mounted on suitable shafts on one side of the apparatus, while the sprockets for chains 75 and 76 are mounted on suitable shafts on the other side of the apparatus so that the chains and sprockets can be adjusted relative to each other for cartons of different sizes. A power unit, such as an electric motor 82, drives conveyor 70 through chains 83 which turn the shafts on which the sprockets at one end of the conveyor are mounted.

A plurality of pairs of fingers 86 are mounted on the pairs of chains 72, 73, and 75, 76, see FIGS. 6, 12 and 21. Each finger 86 is substantially triangular in shape, and has a base 88 carrying therein a roller 89 which is adapted to ride on a guide track 91 or 92 located respectively between the upper runs of chains 72, 73 or 75, 76, see FIG. 12. At this time, fingers 86 extend upwardly through the spaces between plates 64, 65 and 67, 68. The forward end of each finger 86 is swingably connected by a link 95 to a pin 96 which extends between and is connected to either the chains 72, 73 or chains 75, 76. When the conveyor chains swing around sprockets 78, the pairs of fingers 86 swing downwardly and are supported only through pins 86 by their respective chains. If desired, webbing 100 and 101 may be positioned below the lower runs of the conveyor chains in order to support the outer or free ends of the fingers as they move back towards the forming section of the apparatus, as shown in FIG. 6. When the chains swing around sprockets 79, the rollers 89 of the fingers engage the curved forward ends 104 and 105 of tracks 91 and 92, respectively, so that the fingers are moved into the erect position as they move back onto said tracks.

FIGS. 6, 7, 13 and 14 show a suction or vacuum cup arrangement for consecutively drawing blanks 10 downwardly from hopper 52. A suction or vacuum means or arrangement 114 is mounted on base frame 45 near the end thereof adjacent hopper 52 and projects into the space between the hopper and the plates 64, 65 and 67, 78 of track or support means 62. This space between the bottom of the hopper and the support means 62 constitutes a passageway 115 through which blanks can be moved from the hopper down onto the support means by said vacuum arrangement.

The suction or vacuum arrangement 114 includes a pair of carriers or carrier arms 118. As these carrier arms and the parts associated with them are identical, only one will now be described in detail, but the same reference numerals are used for the two carrier arms and their respective parts.

Carrier arm 118 is hollow throughout the length thereof, and a bracket 120 is fixedly mounted on and projects outwardly from the outer end 121 of this arm. Bracket 120 carries a bearing 123 in which is journalled a short shaft 124. A hollow and closed suction arm 127 is fixedly mounted at one end thereon on an end of shaft 124 and extends generally away from the carrier arm. A plurality of suction or vacuum cups 128 are mounted on the upper surface of arm 127 and communicate with the interior thereof. A flexible hose 130 is mounted on a side of arm 118 and extends to a fitting 131. This fitting is mounted on shaft 124 and is such as to provide an air-tight passageway from hose 130 to a passage 133 in and extending longitudinally of shaft 124 which communicates with the interior of suction arm 127 while allowing for rotation of the shaft in its support bearing. The opposite end of hose 130 is connected to a suitable vacuum source, not shown. The vacuum source includes a standard switch arrangement which can be operated selectively to apply a vacuum through hose 130, shaft passage 133 and arm 127 to vacuum cups 128. The vacuum switch arrangement can also be selectively operated to supply pressure air to said cups. A vacuum pressure units and the controls therefor are well known and can be purchased on the market, these have been omitted for the sake of clarity.

The carrier arm 118 is formed with an enlarged hollow inner end 137 mounted on a transverse shaft 140 journalled at its ends in bearings 141 carried by vertical supports 142 mounted on frame 48, see FIG. 6. The large inner end 137 of arm 118 is fixedly connected to shaft 140, and this shaft is oscillated by a power unit 145. The power unit consists of a fluid-operated cylinder 146 swingably mounted at 147 at its lower end on a bracket 148 suspended from frame 48, as shown in FIG. 6. A piston rod 150 extends out of the cylinder and is connected at its outer end to a lever 152 which is inclined upwardly from shaft 140 to which it is keyed. With this arrangement, when piston rod 150 is extended, carrier arm 118 and suction arm 127 are swung downwardly, and when said piston rod is retracted, these arms are swung upwardly.

An endless chain 155 extends through hollow arm 118 and around sprockets 156 and 157 respectively fixedly mounted on shaft 124 and on a hub 158 which is rotatably mounted on shaft 140 within the enlarged inner end 137 of the carrier arm. Another sprocket 160 is fixedly mounted on hug 158, and a chain 162 extending around this sprocket extends out of the inner end 137 of the carrier arm and around a sprocket 163 fixedly mounted on a transverse shaft 164 journalled at its ends in bearings 165 carried by supports 166 mounted on support frame 45. A lever 170 is fixedly mounted on shaft 164 and is inclined downwardly therefrom, its outer end being secured to the upper end of a piston rod 171 projecting out of the upper end of the fluid cylinder 172, the lower end of which is connected to the outer end of the piston rod of another cylinder 173 which is hingedly mounted at 174 on bracket 148, as shown in FIGS. 6 and 13. When the piston rods of cylinders 172 and 173 are extended, lever 170 is swung upwardly to rotate shaft 164 and its sprocket 163. Sprocket 163 rotates sprocket 160 through chain 162, and said sprocket 160 rotates sprocket 157 and the latter rotates sprocket 156 through chain 155. This action swings suction arm 127 downwardly relative to carrier arm 118. The retraction of the piston rods of cylinders 172 and 173 reverses this action and swings the suction arm upwardly relative to the carrier arm.

It will be noted that the suction arrangement 114 is mainly located to one side of passageway 115, while arm 118 extends to said passageway, and suction arm 127 extends across the passageway. When carrier arm 118 is swung up to an upwardly-inclinded position by cylinder 146, suction arm 127 is in a horizontal position at the bottom of hopper 52 with the suction cups 128 in engagement with the lowermost carton blank in the hopper, as shown in FIG. 6. When suction is applied through hose 130 to cups 128, the latter grip the lowermost blank. Following this, cylinder 173 is energized to swing arm 127 downwardly a little thereby drawing the lowermost blank out of the hopper. As arm 118 is swung downwardly by cylinder 146, cylinder 173 is energized to return suction arm 127 to its horizontal position. During the downward movement of arm 118, cylinder 172 holds shaft 164 and sprocket 163 stationary. As a result, sprockets 160 and 157 do not rotate and therefore sprocket 156 has to rotate because of chain 155 extending therearound, and this retains the suction arm 127 in a horizontal attitude as it moves downwardly through passageway 115 and past the plates 64, 65 and 67, 68 of the support means 62. This deposits the gripped blank onto the supporting means. When the vacuum is cut off from cups 128, the blank is left the support means 62. If desired, a short blast of air may be directed after the vacuum has been cut off through hose 130 and out through cups 148 to make a clean break between the cup and the deposited blank at this time.

Cylinder 172 is now energized to extend piston rod 171 thereby rotating the suction arm 127 into a vertical attitude at the side of passageway 115 and clear of the carton blank on the support means. Then cylinder 146 is energized to retract piston rod 151 thereby swinging carrier arm 118 upwardly with the suction arm retained in the vertical attitude. As the carrier arm reaches the top of its travel, cylinder 172 is energized to retract rod 171 to swing suction arm 127 into its horizontal attitude extending across the passageway with the vacuum cups engaging the next lowermost carton blank in hopper 52. A vacuum is now applied to the suction cups to cause the latter to grip the lowermost blank 10 for the next operation.

A pair of swing plates or gates 180 and 181 are located at one side of forming section 38 and operated by a fluid cylinder 182, see FIGS. 6, 7 and 8. Similarly, another pair of swing plates or gates 184 and 185 are located at the opposite side of the forming section and are operated by a fluid cylinder 186. As the operating linkages of gates 180, 181 and 184, 185 are the same, only one will now be described in detail, the same numerals being used for the corresponding linkage parts of the two pairs of gates.

Gate 181 is swingably mounted on a vertical pin 190, and an arm 191 projects outwardly from the gate at the pin. A connecting link 193 extends laterally from arm 191 to another arm 194 mounted on a vertical pin 195. This arm 194 forms part of a bell crank having another arm 196 which is connected by a link 197 to an arm 198 connected to gate 180 at the vertical pin 200 upon which said gate is swingably mounted. Bell crank 194, 196 is swingably mounted on the vertical pin 195. Arm 191 of gate 181 is connected to the piston rod 202 of cylinder 182, while arm 191 of gate 185 is connected to the piston rod 203 of cylinder 186. When rods 202 and 203 are extended relative to their respective cylinders, gates 180, 181 and 184, 185 are closed, that is, they extend across the opposite ends of forming section 38 at opposite sides of passageway 115. When the piston rods 202 and 203 are retracted, the four gates are opened to permit movement into and out of the forming section. The loads of articles for the cartons can be directed into the forming section from either side thereof, but in this example, the containers are directed through feed section 36 into the forming section in the direction of arrow 205 in FIG. 7. The feed section is located on the opposite side of the machine when the loads are to be directed into said opposite side.

The mechanism for folding each carton blank into a tube around a load of containers is illustrated in FIGS. 9, 10 and 11 and can be seen in FIGS. 6, 7 and 8. A pair of horizontal and transverse shafts 210 and 211 are carried at their opposite ends by crossheads 212 slidaly mounted on vertical rods 213 and 214 projecting upwardly from base frame 45. These crossheads and shafts 210 and 211 can be raised and lowered by means of screw mechanism 216. A pair of horizontal upper rails 220 and 221 are carried by shafts 210 and 211 and extend longitudinally of the apparatus above track means 62. The inner ends of rails 220 and 221 are bent upwardly into inclined sections 223 and 224 which are located at one side of forming section 38 above track means 62. The guides 223 and 224 are located so that when a carton blank is drawn downwardly in the forming section, the panels 12 and 14 of the blank engage these inclined guides and are swung up into an inclined position.

Sleeves 235 and 236 are mounted on shafts 210 and 211, respectively, and have hangers 237 and 238 secured to and hanging downwardly therefrom, see FIGS. 7, 9 and 10. These hangers support a horizontal base 239. A pair of axially aligned fluid cylinders 240 and 241 are fixedly secured together at their adjacent inner ends, and slidably extend through bearings 242 and 243 secured to a projecting upwardly base 239. Cylinder 240 has a piston rod 244 connected at its outer end to a bar 245 which, in turn, is fixedly secured to base 239. Cylinder 241 has a piston rod 246, the outer end of which is connected to a link 247 projecting upwardly from a slide 248 mounted in base 239 for movement longitudinally thereof. A plate 249 extends outside and parallel to the bottom of base 239 and is secured to slide 248 by a spacer 250. The forward end of plate 249 is bent upwardly at 251 and has a bar 252 extending across its outer end.

When piston rod 244 of cylinder 240 is extended, the fact that it is connected to base 239 through bar 245 causes this cylinder, cylinder 241, slide 248 and plate 249 to move as a unit away from said bar 245. When piston rod 246 is extended from its cylinder 241, only slide 248 and plate 249 are moved outwardly into forming section 38.

FIGS. 9, 10 and 11 include a mechanism for straightening up carton side wall 12 against a load of articles and then folding panel 14 down over the load, the latter folding action being accomplished by plate 249.

A pair of spaced horizontal supporting bars 254 are carried by hangers 237 and 238 above cylinders 240 and 241. Two gears 255 are fixedly mounted on a common shaft 256 journalled in bars 254, see FIG. 11. A finger 257 is fixedly mounted at one end on shaft 256, is normally inclined upwardly therefrom towards hanger 238, and has a notch 258 opening out from its outer end. Two gears 259 mesh with gears 255 and are mounted on two stub shafts 260 journalled in the bars 254, said stub shafts having curved pressure plates 261 secured thereto and normally hanging downwardly therefrom as shown in broken lines in FIG. 10. Each of these plates has a flat outer end section 262 normally lying in the plane of plate 249. Another finger 263 is fixedly connected to one of the shafts 260 and is normally inclined upwardly therefrom in the direction away from hanger 238. Finger 263 has a notch 264 opening out from its outer end. Horizontal pins 265 and 266 are supported by plate 249 in line with fingers 257 and 263 respectively.

When cylinder 240 is energized, cylinder 241, slide 248 and plate 249 move forwardly. During this movement, pin 265 moves into notch 258 to swing arm 257 forwardly, see FIG. 10. This action causes finger 263 to swing rearwardly through meshing gears 255, 259. The rotation of stub shafts 259 at this time swings plates 261 forwardly to cause the straight sections 262 thereof to engage the adjacent carton wall 12 to straighten the latter upwardly, as shown in full lines in FIG. 10. Cylinder 241 is now energized to move plate 249 forwardly, and pin 266 enters notch 264 of arm 263 to swing said arm forwardly and arm 257 rearwardly back to their original positions. This action swings plate sections 261 back to their normal positions in the plane of plate 249 so that the plates 261 and 249 press the top panel 14 of the carton down onto the load of articles.

When the cylinders 240 and 241 are energized to retract their respective pistons the various elements associated with them are drawn back to their normal positions shown in FIG. 9. In order to allow pins 265 and 266 to return at this time, each of the arms 257 and 263 is formed with a hinged outer end section 268 which is biased into a normal position, but can be swung back in one direction out of said position, see finger 263 in FIG. 10.

At the opposite side of the forming section, see FIGS. 6 and 9, a pair of vertical guide rods 270 depend from a housing 271 carried by the hopper support frame 48, and a black 272 is slidably mounted on these rods. A threaded shaft 273 is journalled in housing 271, extends downwardly through block 272 and is threaded in a nut 274 secured to this block. The screw shaft 273 is rotated by a hand wheel 275 through a bevel gear arrangement 276 in housing 271. The three shafts 270 and 273 are located side by side substantially along the longitudinal centre line of the base frame of apparatus 35.

A horizontal support plate 277 is mounted on the top of block 272 and extends towards the passageway 115. Supports 278 and 279 depend from plate 277 and carry a horizontal base 281. A slide 283 is mounted in base 281 for movement longitudinally thereof, and has a flange or plate 284 projecting downwardly from its outer end. Slide 283 is moved back and forth by a fluid cylinder 287 mounted on the lower surface of base 281, this cylinder having a piston rod 289 projecting therefrom and connected to a link 290 which is secured to and depends from slide 283.

A folder plate 294 normally projects upwardly from a sleeve 295 mounted on a pin 296 carried by slide 283. A link 298 is secured to and is inclined upwardly from sleeve 295, and the outer end of a piston rod 300 is connected to this link, said rod extending outwardly from a fluid cylinder 301, the opposite end of which is connected to a post 302 projecting upwardly from slide 283.

When piston rod 289 is extended from its cylinder 287, slide 283 moves outwardly, folder plate 294 and cylinder 301 moving with it. When piston rod 300 of cylinder 301 is extended, folder plate 294 swings downwardly towards a horizontal position.

When a carton blank is drawn downwardly in forming section 38, the side wall 13 thereof and its securing flap 15 engage plate 294 at one side of said section and are swung up into an inclined position. Plates 294, 284 normally retain side wall 13 in this inclined position. However, a vertical bracket 304 is mounted on frame 45 below the level of plate 284. This bracket is so mounted that it can be adjusted across the forming section to accommodate cartons of different widths and heights. Bracket 304 is needed for short cartons in order to prevent the side walls 13 thereof from falling down when said walls are not tall enough to remain in contact with plate 284 when the carton bottoms are on the support means at the bottom of forming section 38.

Thus when a carton blank is drawn downwardly in the forming section, guides 223, 224 on one side of said section and plates 294, 284 on the other side thereof incline the side panels 12 and 13 upwardly so that the blank is formed into an outwardly expanding U during this movement.

The articles to be inserted into the cartons are arranged in groups of any desired number in feed section 36, and are moved over a trough bottom plate 310 towards the forming section 38 of the apparatus, see FIGS. 8 and 12. The group of containers is moved from the bottom plate over a ramp or loading chute 312, said ramp or chute having opposite upstanding side walls 313. The inner edge of the ramp rests on the edge of a carton blank resting on supporting plate 68, while sleeve 314 secured to the undersurface of the ramp near its outer edge is mounted on a supporting shaft 315. The chute 312 is movable from a horizontal position, as shown in FIGS. 8 and 12, at which time it can overlap and clamp a portion of the carton blank resting on plate 68, to a substantially vertical position.

If apparatus 35 is designed for handling only single tiers of articles, the power means for swinging chute 312 can be below the latter. However, the illustrated apparatus 35 can handle single and double tiers, in which case the power means is above the chute. An arm 317 inclined downwardly from sleeve 314 is connected by a vertical link 318 to one arm 319 of a bell crank mounted on a supporting shaft 321, the other arm 322 of this bell crank being connected to a piston rod 323 of a fluid cylinder 324. After a group or load of articles or containers has been moved into the forming section, cylinder 324 is energized to swing ramp 312 upwardly out of the way.

The illustrated apparatus 35 is designed so that it can be adjusted to handle two tiers of articles, if desired. The upper tier of articles is moved towards the forming section over a loading plate 328 spaced above loading plate 310, see FIG. 12. When the upper and lower tiers of articles are moved towards the forming section, the articles of the upper tier move off plate 328 onto the articles of the lower tier. As the upper tier articles progress, they move between upper side walls or guides 332 which are fixedly mounted on shaft 321 and extend parallel to chute 312. The upper articles also move beneath a stabilizer plate 335 which extends towards the forming section from a sleeve 336 rotatably mounted on shaft 321. An arm 338 fixed to and inclined upwardly from sleeve 336 is connected to a piston rod 339 of a fluid cylinder 340. Stabilizer plate 335 is inclined downwardly slightly so that as the articles move beneath it they press the free or inner edge of the plate upwardly, but when the last article clears the plate, the latter drops downwardly slightly to engage the last row of articles to prevent them from springing back out of position. When apparatus 35 is adjusted to handle an upper tier of articles, it is necessary to provide gates 180 and 181 with upwardly-projecting extensions 342 and 343, shown in dotted lines in FIG. 6. These extensions oppose movement of the upper tier of articles and so stop said articles in the correct position in the forming section.

As it is desirable to hold each blank firmly in the forming section during upward movement of the carrier arms 118 and the loading of articles onto the blank, a clamp arrangement is provided for gripping the portion of the blank resting on supporting plate 65 near the gates 180, 181. This is shown in FIGS. 7 and 8. A hold-down plate 346 is fixedly mounted at one end on a shaft 347 which is carried by bearings 348 mounted on the base frame 45 just beneath the level of gates 180, 181. This plate 346 extends inwardly of the machine and is long enough to overlap a portion of a carton blank resting on plate 65. A lever 350 is fixedly secured to an end of shaft 347 and is connected at its outer end to the upper end of the piston rod 351 of a fluid cylinder 352 which is mounted at its lower end on a bracket 353 carried by frame 45. When piston rod 351 is extended, the hold-down plate 346 is in a horizontal or gripping position, and when said piston rod is retracted, the hold-down plate is swung upwardly out of the way.

FORMING AND LOADING OPERATION

A stack of blanks 10 is maintained in hopper 52. As stated above, the corrugations of end plates 55 and 56 keep the load of most of the blanks off the lowermost one. At the beginning of a forming and loading cycle, hold-down plate 346, chute 312, side walls 332 and stabilizer plate 335, if the latter is used, are in vertical positions out of the way, gates 180, 181 and 184, 185 are open, slides 248 and 283 are retracted away from the forming section, and carrier arms 118 are upwardly-inclined with the suction arms 127 in the horizontal attitude with vacuum cups 128 against the undersurface of the lowermost blank in the hopper. Vacuum is applied to the cups at this time. Power cylinder 173 is energized to incline arms 127 slightly downwardly, thereby drawing a carton blank out of the hopper. The power cylinder 146 is energized to start the arms 118 swing downwardly while cylinder 173 is again energized to return arms 127 to their horizontal attitudes. As the arms 118 continue to swing downwardly, chain 155 and sprockets 156, 157 maintain the vacuum arms in the horizontal attitude. During this movement, parts of the blank engage the inclined guides 223, 224 and plates 294, 284 so that the blank is folded into an outwardly expanding U. If the side wall 13 is relatively short and clears plates 294, 284 when the blank bottom 11 is resting on the support means 62, said side wall is kept in an inclined position by bracket 304. The partially formed carton is at this time fully open at both ends. Then the chute 312 and the hold-down plate 346 are swung downwardly to clamp the deposited blank on the support means 62. The vacuum is maintained on cups 128 until the partially formed carton blank is clamped in position. Then the vacuum is cut off cups 128 and pressure air is directed into these cups for an instant to separate them cleanly and quickly and from the blank. Cylinder 172 is energized to swing the vacuum arms 127 into a substantially vertical position hanging down from the carrier arms and to one side of the passageway 115 in the forming section. The carrier arms 18 are now swung upwardly, and as they near the upper part of their travel, the vacuum arms are swung back into the horizontal attitude and vacuum is applied to the cups 128 so as to grip the carton blank that is now lowermost in the hopper.

Figure 3:
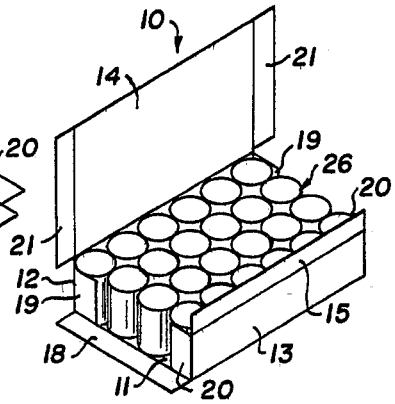
Figure 2:
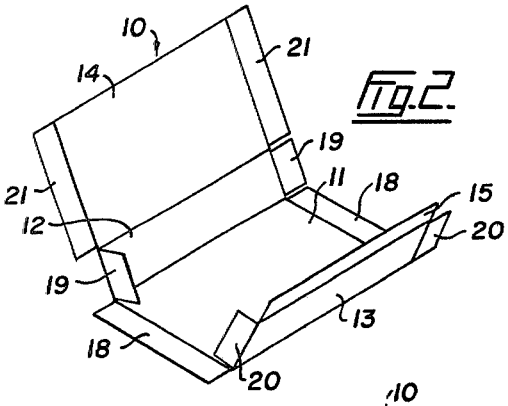

Cylinder 182 is energized to close gates 180, 181, and this swings the end flaps 19 and 20 of the side walls of the deposited blank inwardly across the end of the blank bottom panel 11, as shown in FIG. 2. At the same time, cylinders 240 and 287 are energized to move slides 248 and 283, respectively, inwardly to straighten up the side walls or panels of the blank. As slide 248 is moved inwardly, plates 261 is swung out of its normal position, as described above, so that its end section 262 is in a vertical position to engage carton wall 12 to straighten said wall up, see FIG. 10. Simultaneously, plate 284 of slide 283 engages the opposite side wall of the carton to straighten up the latter wall. The single tier or double tier of articles is or are moved into the forming section over the bottom of the carton blank against the infolded end flaps which are braced by gates 180, 181, at this time. If a double tier is being loaded, the upper tier is moved against the vertical extensions 342, 343 of these gates, and the free edge of stabilizer plate 335 drops down behind the articles of this upper tier to keep them in place. Cylinders 324 and 340 are now energized to raise chute 312 and upper side guides 332 out of the way, and cylinder 186 is energized to close gates 184, 185. This swings the opposite end flaps 19 and 20 of the blank inwardly across the end of bottom panel 11, as shown in FIG. 3.

Guns 345, which are mounted at the outer side of forming section 38, are operated to squirt glue onto the outer surface of flap 15, following which cylinder 301 is energized to swing folder plate 294 downwardly. This swings glue flap 15 into the horizontal position. Cylinder 241 is energized to move slide 248 and its plate 249 inwardly to swing the top blank panel 14 inwardly and down onto the glue flap, said plate pressing the panel against the flap at this time. As slide 248 moves inwardly, plates 261 is swung back to its normal position out of the way, as described above. The closed container is shown in FIG. 4. Its upper and lower end flaps 18 and 21 at this time are still projecting outwardly from the ends of the main body of the carton.

Motor 82 is energized to start conveyor 170 moving. This causes a pair of fingers 86 of the conveyor to engage the side wall 13 of the folded carton or case and to move it out of forming section 38 into folding section 40. The bottom flap 11 of the blank slides from under hold-down plate 346 during this movement of the loaded carton. Following this, the hold-down plate and the stabilizer plate 335, if the latter is used, are swung out of the way. Slide plate 249 and then rails 220 and 221 keep the top panel 14 pressed downwardly during this movement. Following this, plate 249 and slide 283 and their associate elements are withdrawn from the forming section, and the 180, 181, and 184, 185 are swung into the open position.

Glue is applied to the end flaps 19 and 20 and/or end flaps 18 and 21 at opposite ends of the cartons, following which end flaps 18 and 21 are folded inwardly, in folding section 40. As the folding mechanism is exactly the same at each end of the carton, one will now be described in detail, but the same reference numerals are used on the same parts at both sides of the machine.

FOLDING SECTION

Upper and lower horizontal end folding plates 355 and 356 in folding section 40 are at the levels of rails 220, 221 and plates 64, 67, respectively, the upper plate being shown in the upper side of FIG. 16, and the lower plate in the lower side of said Figure. Upper plate 355 twists into a vertical section 357, while lower plate 356 twists into a vertical section 358, see FIG. 17. Upper plates 355 is a little advanced relative to lower plate 356 with respect to the movement of the cartons through the apparatus, as shown in FIG. 17, so that upper end flaps 21 are folded downwardly before the lower end flaps 18 are folded upwardly.

Any suitable glue applicating means can be used. In this example, glue guns 359 are located on opposite sides of track means 62 so as to spray glue on to the infolded end flaps 19 and 20 prior to the folding of flaps 18 and 21, see FIGS. 6, 7, 16 and 17.

As each carton with its load is moved through apparatus 35, upper flaps 21 thereof engage the upper folding plates 355 at opposite sides of the machine and are folded downwardly thereby. The lower end flaps 18 engage lower folding plates 356 and are folded upwardly thereby, following which the carton continues to advance into sealing section 42.

SEALING SECTION

Sealing section 42 is made up of a spaced parallel identical side sections 360 and 361. One or both of these sections is mounted so as to be movable towards and away from the other section so as to accommodate cartons of different sizes.

Vertical shafts 363 and 364 are mounted at the entrance end 365 and discharged end 366 of the sealing section. An endless belt 369 extends around rollers 370 and 371 mounted respectively on shafts 363 and 364. Tracks or plates 64 and 67 extend through the sealing section. If desired, shaft 364 can be mounted so as to be adjustable towards and away from shaft 363 in order to enable the tension on belt 369 to be adjusted.

Shaft 363 extends downwardly into a gear box 375 which is operatively connected to a motor 376 through a chain drive 377 see FIG. 6. Upper plates 385 and 386 extend longitudinally through section 42 above plates 64 and 67. These upper plates are aligned with rails 220 and 221 so that they exert a pressure on the upper surface of the carton as it moves through this section.

Conveyor 70 directs each carton into sealing section 42 where belts 369 on opposite sides thereof pick it up and exert pressure against the infolded end flaps to firmly press them together and to hold them in this position until the glue has set. Downward pressure is maintained on the carton by plates 385 and 386 at this time.

FEED SECTION

In the preferred form of this invention, feed section 36 consists of a relatively long trough 400, the bottom of which is formed by plate 310, see FIG. 18. A pusher plate 402 extends across the trough and is in a vertical position when it is operating to push a load of articles into the forming section 38 of the apparatus. The pusher plate is moved back and forth in any suitable manner, such as by a piston rod 405 of a long fluid cylinder 406, which is suitably mounted at the outer end of the trough. Although the piston rod may be connected directly to plate 402, it is preferable to connect the rod indirectly to the plate so that while one load of articles is being moved into the forming section by the pusher plate, another load can be forming in the trough behind the plate.

A slide 409 rides on a pair of rods 410 which extend longitudinally of the trough 400 and are spaced well above the bottom 310 thereof so that slide 409 can move over articles located in the trough. A shaft 414 is journalled in bearings 415 mounted on slide 409 and extends transversely of the trough. A link 417 is fixedly connected to this shaft 414 and extends downwardly therefrom through an opening 418 in the slide, see FIGS. 18 and 20. A connector 420 connects the lower end of link 417 to the upper end of another link 421 which is fixedly secured at its opposite end to a transverse shaft 424 journalled in extensions 425 projecting from slide 409 towards the pusher plate. Lugs 427 secured to plate 402 near the side edges and the top edge of said plate are fixedly secured to shaft 424. An arm 430 is secured to an end of shaft 414 outside slide 409 and is inclined upwardly relative thereto, see FIG. 18, and a roller 431 is carried by the upper end of this arm on the outer side thereof.

The upper portion 435 of a side wall of trough 400 is relatively thick and has upper and lower tracks 437 and 438 extending the length thereof and opening inwardly of the trough throughout their respective lengths. The tracks 437 and 438 are actually slots formed in the inner surface of wall 435. A horizontal divider 439 separates the upper and lower tracks from each other.

An inner dog 442 normally extends across track 437 near the inner end thereof, said dog being mounted at one end thereof on a pin 443 located in line with divider 439. This dog 442 is biased into an upwardly-inclined position extending across track 437. The lower track 438 is formed at its inner end with a curved ramp 445 which extends generally in the same direction as dog 442 and is spaced therebelow a distance sufficient to permit roller 431 to travel down the ramp beneath this dog. An outer dog 448 is provided near the outer ends of tracks 437, 438. This dog 448 is swingably mounted on a pin 449 positioned in line with divider 439 near the outer end of the tracks. Dog 448 is biased to and retained in a horizontal position at which time its upper surface 450 is in line with the bottom of upper track 437 which is formed by the upper surface of divider 439. Track 438 is provided with another ramp 453 at its outer end, this ramp curving from the bottom of track 438 up to the bottom of track 437. The location of outer dog 448 is such that roller 431 can travel up the bottom ramp 453 while swinging the dog upwardly. When the roller clear the dog, the latter returns to its normal horizontal position.

When roller 431 is in upper track 437, as shown in FIG. 18, the linkage between it and pusher plate 402 is such that the plate is retained in a vertical position. At this time, piston rod 405, which is connected to slide 409 at 458, see FIG. 20, moves the pusher plate towards the forming section 38 when cylinder 406 is energized to extend the rod. The stroke of the cylinder and rod is such that a load of articles moved by the pusher plate over plate 310 is located properly within the forming section 38 when the rod reaches the end of its stroke. At this time, roller 431 has depressed and ridden over inner dog 442 and cleared the latter so that it springs back to its normal position. When cylinder 406 retracts rod 405, roller 431 travels downwardly over ramp 445 into lower track 438. This swings the pusher plate 402 back into a substantially horizontal position, shown in dotted lines in FIG. 18, so that it can travel over the tops of any articles assembled within trough 400. As the roller reaches the outer end of track 438, it rides up ramp 453, lifting lug 448 at this time until the roller is back in track 437. The outward movement of piston rod 405 stops after the roller clears lug 448 which springs back to its normal horizontal position. This movement of the roller returns the pusher plate to its vertical operative position. With this arrangement, a load of articles can be placed in the trough behind the pusher plate while said plate is moving a load of articles into the forming section 38 of the apparatus. On its return journey, the pusher plate is in an upper horizontal position so that it clears the latter articles at this time, and then drops down behind the new load. As described above, the vacuum cups 128 after having deposited a carton blank on the supporting means of the forming section, are moved upwardly to grasp the next carton blank in the feed hopper while a load of articles is being moved onto the partially-formed blank in the forming section and the carton blank is being wrapped around this load. Thus, the speed of operation of apparatus 35 is increased without the necessity of having to move the various operating elements any faster than was done with the similar apparatus of the U.S. Pat. No. 3,782,071.

GENERAL OPERATION

The operation of apparatus 35 is obvious from the above. A carton blank is drawn by vacuum cups down into forming section 38 and is folded into an outwardly expanding U at this time. After the partially formed carton blank has been clamped in place, the vacuum cups are moved to grip another carton blank, while folding gates are operated to fold inwardly end flaps at one end of the blank. A single or double tier of articles is moved in a group onto the bottom panel of the partially folded blank. Gates are operated to fold the opposite end flaps of the blank inwardly, and the side panels of the blank are moved into the upright position. Glue is applied to the outer surface of glue flaps 15, and after the latter has been folded inwardly, the top panel of the carton is folded over and pressed against the glue flap.

The loaded carton is then moved through folding section 40 where glue is applied to the infolded side end flaps 19 and 20, and the top and bottom end flaps 18 and 21 are folded over these flaps. Then the carton progresses through sealing section 42 where all of the glued flaps are firmly pressed in position and retained until the glue has set.

The upstanding fingers 86 connected to the chains 72, 73 of conveyor 70 move the cartons through the apparatus. At this time, the fingers 86, shown in dotted lines in FIG. 21, are retained in the erect position by their respective rollers 89 riding on tracks 91 and 92.

CARTON TRAY ALTERNATIVE

The apparatus described above is primarily for completely enclosing loads of articles within cartons. This apparatus can also be easily and quickly made to handle tray cartons which are loaded with articles but are open at the top. If desired, the apparatus can be constructed to handle trays only.

FIGS. 21, 22 and 23 disclose an arrangement for folding a tray carton blank and transporting it after it has been loaded. The tray carton blank is the same as blank 10, but top panel 14, top end flaps 21 and glue flap 15 are omitted. Frequently, the side panels 12 and 13 of the tray cartons are not as high as those of the complete cartons. The tray blank is drawn down into forming section 38 in the same manner as the blank described above. During the downward trip, side walls 12 and 13 are folded upwardly to form an outwardly extending U. End flaps 19 and 20 at the end of the blank remote from the feed section of the apparatus are folded inwardly. At the same time, slide 248 is moved inwardly, to shift plates 261, 262, inwardly and swing said plate downwardly on one side of passageway 115. Slide 283 is also moved inwardly to shift plates 284, 294 in the same direction on the opposite side of the passageway, as shown in dotted lines in FIG. 21. The side walls 12 and 13 of the tray are not high enough to be touched by plates 261, 262 and 284, 294, but the latter acts as guides or supporting walls for the incoming load. After the load of articles has been moved between said guides onto the lower panel 11 of the blank, the remaining side end flaps 19 and 20 are folded inwardly and the plates 261, 262 and 284, 294 are retracted. As there is nothing with this arrangement to hold the side walls and end flaps in position at this time, the conveyor 70 is provided with a special finger arrangement to hold up the side walls and to move the loaded tray cartons of the forming section.

In this alternative, each finger 86 is replaced by a relatively short finger 460 mounted on base 88, said finger having an outwardly curved flange 461 at its upper end. A front finger 465 is connected to the pair of chains 72, 73 in the same manner as finger 460. The front finger is spaced ahead of back finger 460 a distance which is a little more than the width of the bottom panel 11 of the tray cartons being handled. The front finger has a base 467 which is connected at its rearward end by a link 468 and a pin 469 to chains 72, 73. This finger base also has a roller 472 at its forward end which rides on rail 91 and is much narrower than roller 89 of the trailing finger 460. This rail 91 is formed with a shallow V recess 474 in its upper edge into which roller 472 rides when the fingers 460 and 465 move into position in the forming section to receive a partially folded carton blank therebetween. Side plates 478 and 479, see FIG. 22, are secured to the sides of rail 91 at the V-recess 474. The roller 89 of finger 86 is wide enough to ride on the upper edges of side plates 478 and 479 which are aligned with the upper edge of rail 91, while roller 472 is not so wide and, therefore, rides down into the recess, as shown in FIG. 21. When the tray carton blank is moved down in the forming section 38 onto the supporting means thereof, the side walls 12 and 13 thereof are inclined outwardly and fingers 460 and 465 retain said side walls in the inclined position. At this time, the lower end of finger 460 is at or spaced a little away from the adjacent edge of the bottom panel 11 of the blank. As roller 472 of finger 465 is now down at the bottom of the recess 474, the front finger is inclined away from the opposite edge of the blank bottom panel. The tray carton blank is clamped in the usual manner on the supporting means by plates 312 and 346, and plates 261, 262 and plates 284, 294 are moved inwardly as described above so that said plates are in position to keep the incoming load of articles in proper shape. In other words, plates 261, 262 and 284, 294 act as side walls for the incoming load. When the conveyor 70 starts to move, roller 472 rides up the inclined bottom of recess 474 until it reaches the upper edge of track 91. As this takes place, finger 465 is tipping towards the load of articles on the bottom panel of the tray while finger 460 is moving this load. During this movement, finger 460 straightens up side wall 13 of the blank, and the tipping of the front finger straightens up the side wall 12. Plates 261, 262 and 284, 294 are retracted in the manner described above. Thus, the tray and its load are firmly gripped between fingers 465 and 460 when the loaded tray is being shifted out of the forming section. As the loaded tray advances through folding section 40, glue is applied to the outer surfaces of side end flaps 19, 20 and/or on the inner surfaces of bottom flaps 18, and these bottom flaps are folded up against the side end flaps. The bottom end flaps are pressed inwardly as the loaded tray passes through sealing section 42, during which time the glue sets sufficiently to hold these flaps firmly in position.

If the tracks 91 and 92 of the apparatus are formed with the V recesses 474 in the upper edges thereof and side plates 478 and 479 are applied to each of these tracks at their respective recesses, the apparatus can be used for either complete cartons or tray cartons. For complete cartons, the front fingers 465 are omitted and fingers 86 are used, and the rollers of fingers 86 ride over the recesses 474 on the upper edges of plates 478 and 479, without affecting the operation of the apparatus. If it is desired to form and load tray cartons, the front fingers 465 and back fingers 460 are appropriately connected to the chains 72, 73 and 75, 76, after which the apparatus operates as described immediately above.

We claim:

1. Apparatus for folding carton blanks having a bottom panel, side walls, side end flaps and bottom end flaps, comprising:

supporting means in a forming section, a hopper at the forming section above the supporting means for holding a stack of substantially flat carton blanks, vacuum means for engaging while in an operative attitude the lowermost blank of the stack in the hopper and moving said engaged blank downwardly through a passageway between the hopper and the support means into a loading position on the supporting means, forming means beside the passageway for engaging side portions of the blank being moved downwardly through the passageway to incline said side portions into a partially formed carton in the configuration of an outwardly expanding U while leaving an end of the carton open, a carrier for the vacuum means for moving said vacuum means between the hopper and the supporting means, control means for the vacuum means for moving said vacuum means after a blank has been deposited in the loading position on the supporting means to an inoperative position to a first side of the passageway clear of the deposited blank and moving said vacuum means past the deposited blank and back to the operative position after the vacuum means is moved above said deposited blank, and means defining a path for moving a load of articles horizontally through a second side of the passageway and through said open carton end onto the bottom panel of the deposited blank within the U formation thereof.

2. Apparatus as claimed in claim 1 comprising clamping means for releasably securing on the supporting means each blank deposited thereon before said vacuum means is moved upwardly by the carrier.

3. Apparatus as claimed in claim 1, comprising:

first stop means at a third side of the passageway opposite the second side thereof to oppose each load of articles and to stop said each load on the bottom panel of the deposited blank.

4. Apparatus as claimed in claim 3 in which said first stop means comprises:

a first pair of gates swingably mounted for horizontal movement, and power means connected to the first pair of gates to swing the gates to a closed position to stop movement of said each load on said bottom panel and to an open position out of the way, said gates being positioned to fold side end flaps of the carton blanks inwardly when the gates are being moved to the closed position.

5. Apparatus as claimed in claim 1 comprising:

second stop means at the second side of the passageway to prevent movement of each article load off said bottom panel back along said path.

6. Apparatus as claimed in claim 5 in which said second stop means comprises:

a second pair of gates swingably mounted for horizontal movement, and power means connected to said second pair of gates to swing the gates to a closed position after an article load has been moved on the bottom panel of a carton blank to stop movement of the load on said bottom panel and to an open position out of the way, said second gates being positioned to fold side end flaps of the carton blanks inwardly when the second gates are being moved to the closed position.

7. Apparatus as claimed in claim 1 comprising a pusher plate positioned to move a load of articles along said path through the open end of a partially formed carton on the supporting means, and power means connected to the pusher plate operable to reciprocate the pusher plate along the path.

8. Apparatus as claimed in claim 1 comprising a slide mounted above said path for movement longitudinally of the path, a pusher plate hingedly mounted at an edge thereof on the slide and extending across the path, power means connected to the slide operable to reciprocate said slide along the path towards and away from said passageway, and control means for maintaining the pusher plate in a vertical position while the slide is being moved towards the passageway to move a load of articles along the path through the open end of a partially formed carton in the supporting means, and said control means swinging the pusher plate into a substantially horizontal position while the slide is being moved away from the passageway.

9. Apparatus as claimed in claim 1 comprising means in the forming section for folding the side end flaps inwardly along the carton, a folding section beside said forming section, said supporting means extending into said folding section, a conveyor extending through the forming and holding sections near said supporting means to move the loaded carton from the forming section through the folding section, and means in said folding section positioned to bear against the folded top panels to press said panels against the securing flaps as the cartons are moved through the folding section.

10. Apparatus as claimed in claim 9 in which said conveyor comprises an endless chain mounted for movement beneath the supporting means in the forming and folding sections, and a main finger connected to said chain projecting outwardly therefrom and positioned to move into the forming section to engage a loaded carton therein and to move said carton through the folding section.

11. Apparatus as claimed in claim 10 comprising a front finger connected to said chain ahead of the main finger and projecting outwardly from the chain, means for tipping the front finger away from the main finger when said fingers move into the bottom of said passageway, said fingers being spaced apart to receive a partially formed carton therebetween, and means for tipping the front finger back towards the main finger to cause said fingers to grip the carton therebetween.

12. Apparatus as claimed in claim 11 in which said conveyor comprises an endless chain to which said main finger and said front finger are swingably attached, and a track extending through the forming and folding sections, a roller connected to the main finger behind the latter to ride on said track to maintain said main finger projecting outwardly from the chain, a roller connected to the front finger ahead thereof to ride on said track to maintain the front finger projecting outwardly from the chain, said tipping means comprising a V recess in the rail into which the roller of the first finger rides to cause the tipping thereof, and means at said recess for preventing the roller of the main finger from riding into said recess.

13. Apparatus for folding carton blanks having a bottom panel, side walls, side end flaps and bottom end flaps, comprising:

an open-bottomed hopper for holding a stack of substantially flat carton blanks above a forming section, supporting means in the forming section spaced below the hopper, the space between the hopper and the supporting means constituting a passageway through which blanks can be moved, a carrier arm mounted to one side of the passageway having an inner end extending to the passageway, a vacuum arm having vacuum cup means thereon, hinge means connecting an end of the vacuum arm to said inner end of the carrier arm, power means connected to the carrier arm to oscillate the inner end thereof vertically through down and up strokes between the bottom of the hopper and said supporting means, control means connected to the vacuum arm to maintain said vacuum arm in a substantially horizontal attitude extending transversely of the passageway while the carrier arm is moving through a down stroke, said vacuum arm being positioned with the vacuum cup means thereof in engagement with the lowermost blank in the hopper when the carrier arm is at the end of an up stroke and moving the blank gripped by the vacuum cup means down through the passageway and onto the supporting means during a down stroke, and operating means connected to the vacuum arm operable to swing said vacuum arm into a substantially vertical attitude at the end of a down stroke of the carrier arm, maintain the vacuum arm in said vertical attitude while the carrier arm is moving through an up stroke and swing the vacuum arm back to the horizontal attitude at the end of the up stroke.

14. Apparatus as claimed in claim 13 comprising hinge means mounting an outer end of the carrier arm, said power means being connected to said carrier arm to swing the latter about said hinge means.

15. Apparatus as claimed in claim 13 comprising forming means beside the passageway for engaging side portions of the blank being moved downwardly through the passageway to incline said side portions into a partially formed carton in the configuration of an outwardly expanding U while leaving an end of the carton open, and means defining a path over which a load of articles can be moved horizontally through said open carton end onto the bottom panel of the deposited blank within the U formation thereof.

16. Apparatus as claimed in claim 15 for carton blanks having top panels and top end flaps, and comprising folding means at said passageway for successively raising the side walls of the partially formed carton and folding the top panel thereof over the article load.

17. Apparatus as claimed in claim 16 in which said folding means comprises first and second slide plates on opposite sides of said passageway, and power means for moving said slide plates inwardly against the inclined portions of the blank to move said portions into vertical positions after an article load has been moved on the said blank.

18. Apparatus as claimed in claim 17 comprising power means for moving said first slide further inwardly to fold the top panel of the blank over the article load.

19. Apparatus as claimed in claim 14 in which said control means comprises a first sprocket connected to the vacuum arm at the hinge means thereof, a second sprocket mounted at the hinge means of the carrier arm, an endless chain trained around said sprockets, and means retaining said second sprocket stationary while the carrier arm moves through the down stroke thereof.

20. Apparatus as claimed in claim 19 in which said operating means comprises power means connected to said second sprocket selectively operable to rotate said second sprocket in one direction to move the vacuum arm into the horizontal attitude and in the opposite direction to move said vacuum arm into the vertical attitude.

21. Apparatus as claimed in claim 20 in which said power means connected to the second sprocket comprises a third sprocket fixedly connected to the second sprocket to rotate therewith, a fourth sprocket aligned with the third sprocket, an endless chain trained around the third and fourth sprockets, and power means connected to the fourth sprocket selectively operable to rotate the latter sprocket in opposite directions.

22. Apparatus as claimed in claim 15 comprising clamping means for releasably securing on the supporting means each blank deposited thereon before the vacuum arm is moved into the vertical attitude thereof.

23. Apparatus for folding carton blanks having top and bottom panels, side walls, side end flaps and top and bottom end flaps, comprising:

supporting means in a forming section, a hopper at the forming section above the supporting means for holding a stack of substantially flat carton blanks, vacuum means for engaging while in an operative attitude the lowermost blank of the stack in the hopper and moving said engaged blank downwardly through a passageway between the hopper and the supporting means into a loading position on to the supporting means, forming means beside the passageway for engaging side portions of the blank being moved downwardly through the passageway to incline said side portions into a partially formed carton in the configuration of an outwardly expanding U while leaving an end of the carton open, a carrier for the vacuum means for moving said vacuum means between the hopper and the supporting means, control means for the vacuum means for moving said vacuum means after a blank has been deposited in the loading position on the supporting means to an inoperative position to a first side of the passageway clear of the deposited blank and moving said vacuum means past the deposited blank and back to the operative position after the vacuum means is moved above said deposited blank, means defining a path for moving a load of articles horizontally through a second side of the passageway and through said open carton end onto the bottom panel of the deposited blank within the U formation thereof, first stop means at a third side of the passageway opposite the second side thereof to oppose each load of articles and to stop said each load on the bottom panel of the deposited blank, second stop means at the second side of the passageway to prevent movement of each article load off said bottom panel back along said path, conveyor means for moving each blank with its article load out of said passageway through a fourth side thereof, and folding means for folding end flaps of the loaded blank over the article load.

24. Apparatus as claimed in claim 23 in which said first stop means comprises:

a first pair of gates swingably mounted for horizontal movement, and power means connected to the first pair of gates to swing the gates to a closed position to stop movement of said load on said bottom panel and to an open position out of the way, said gates being positioned to fold side end flaps of the carton blanks inwardly when the gates are being moved to the closed position, said second stop means comprising a second pair of gates swingably mounted for horizontal movement, and power means connected to said second pair of gates to swing the gates to a closed position after an article load has been moved on the bottom panel of a carton blank to stop movement of said load on said bottom panel and to an open position out of the way, said second gates being positioned to fold side end flaps of the carton blanks inwardly when the second gates are being moved to the closed position; and said folding means comprises folers for successively folding the top end flaps and bottom end flaps of the load blank over said infolded side end flaps.

25. Apparatus for folding carton blanks cut and creased for cartons having top and bottom panels, side walls connected to opposite edges of the bottom panel, a securing flap connected to a free edge of one of the side walls, side end flaps connected to ends of the side walls and top and bottom end flaps connected respectively to the top panel and the bottom panel, said top panel being connected to a free edge of the other one of the side walls, comprising a forming section and a folding section arranged in succession, supporting means extending through said sections, and a conveyor extending through the forming and folding section near said supporting means, said forming section comprising an open-bottomed hopper above the supporting means for holding a stack of substantially flat carton blanks, the space between said hopper and the supporting means constituting a passageway through which blanks can be moved from the hopper down onto the supporting means, a carrier arm mounted to one side of the passageway having an inner end extending to the passageway, a vacuum arm having vacuum cup means thereon, hinge means connecting an end of the vacuum arm to said inner end of the carrier arm, power means connected to the carrier arm to oscillate the inner end thereof vertically through down and up strokes between the bottom of the hopper and said supporting means, control means connected to the vacuum arm to maintain said vacuum arm in a substantially horizontal attitude extending transversely of the passageway while the carrier arm is moving through a down stroke, said vacuum arm being positioned with the vacuum cup means thereof in engagement with the lowermost blank in the hopper when the carrier arm is at the end of an up stroke, and moving the blank gripped by the vacuum cup means down through the passageway and onto the supporting means during a down stroke, and operating means connected to the vacuum arm operable to swing said vacuum arm into a substantially vertical attitude at the end of a down stroke, maintain the vacuum arm in said vertical attitude while the carrier arm is moving through an up stroke, and swing the vacuum arm back to the horizontal attitude at the end of the up stroke, guide means for engaging opposite side walls of the blank as said blank is drawn downwardly and for inclining the side walls and the respective securing flap and top panel connected thereto upwardly and outwardly into an upwardly outwardly expanding U while concurrently leaving at least one end of the carton open, means defining a path for moving a load of containers through said open end out the bottom panel of the blank within said outwardly expanding U, folding means in the forming section for swinging said side end flaps inwardly, folding the securing flap inwardly, and folding the top panel over the container load and the infolded securing panel to form a carton around said load.

26. Apparatus as claimed in claim 25 comprising means in said folding section for folding said top and bottom flaps over the infolded side end flaps as said carton is moved through the folding section by the conveyor.

27. Apparatus as claimed in claim 26 comprising application means in the forming section and in the folding section to apply glue respectively to said securing flap before the top panel is folded thereon and to portions of said end flaps before the top and bottom flaps are folded.

28. Apparatus as claimed in claim 27 comprising pressure means in the folding section positioned to bear against the folded top panels to press said panels against the securing flaps as the cartons are moved through the folding section.

29. Apparatus as claimed in claim 28 comprising a sealing section aligned with said folding section to receive cartons moved therefrom by the conveyor, and pressure means in said sealing section for moving the cartons therethrough and pressing the folded end flaps until said glue can hold said end flaps.

30. Apparatus for folding carton blanks having bottom panels, side walls, side end flaps and bottom end flaps, comprising:

a forming section and a folding section arranged in succession, supporting means extending through said sections, an open-bottomed hopper above the supporting means in the forming section for supporting a stack of substantially flat carton blanks, vacuum means operable to engage the lowermost blank in the hopper and draw said blank downwardly through a passageway on to the supporting means, folding means beside the passageway for engaging side portions of the blank being moved downwardly through the passageway to incline said side portions into a partially formed carton in the configuration of an outwardly expanding U while leaving an end of the carton open, means defining a path for moving a load of articles horizontally through said open carton end on to the bottom panel of the deposited blank within the U formation thereof, and a conveyor extending through the forming and folding sections near said supporting means, said conveyor comprising a main finger projecting from the conveyor and positioned to engage a loaded carton on the supporting means in the forming section, a front finger on the conveyor ahead of the main finger and projecting from the conveyor, means for tipping the front finger away from the main finger when said fingers move into the forming section to receive a partially formed carton therebetween, means for tipping the front finger back towards the main finger to cause said fingers to grip the carton therebetween.

* * * * *